US008945318B2

(12) United States Patent
Yoshimura et al.

(10) Patent No.: US 8,945,318 B2
(45) Date of Patent: Feb. 3, 2015

(54) R-FE-B TYPE RARE EARTH SINTERED MAGNET AND PROCESS FOR PRODUCTION OF THE SAME

(75) Inventors: Koshi Yoshimura, Osaka (JP); Hideyuki Morimoto, Osaka (JP); Tomoori Odaka, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 6 days.

(21) Appl. No.: 13/456,250

(22) Filed: Apr. 26, 2012

(65) Prior Publication Data

US 2012/0206227 A1 Aug. 16, 2012

Related U.S. Application Data

(63) Continuation of application No. 12/666,323, filed as application No. PCT/JP2008/001727 on Jul. 1, 2008, now Pat. No. 8,187,392.

(30) Foreign Application Priority Data

Jul. 2, 2007 (JP) ..... 2007-174063

(51) Int. Cl.

| | |
|---|---|
| ***H01F 7/02*** | (2006.01) |
| ***C22C 38/00*** | (2006.01) |
| ***B22F 3/24*** | (2006.01) |
| ***C22C 33/02*** | (2006.01) |
| ***H01F 1/057*** | (2006.01) |
| ***H01F 41/02*** | (2006.01) |

(52) U.S. Cl.

CPC ..... *C22C 38/005* (2013.01); *B22F 3/24* (2013.01); *C22C 33/0278* (2013.01); *H01F 1/0577* (2013.01); *H01F 41/0293* (2013.01); *B22F 2003/248* (2013.01); *B22F 2999/00* (2013.01); *C22C 2202/02* (2013.01)

USPC ..... 148/101; 148/122; 148/302

(58) Field of Classification Search

CPC .... C22C 33/0278; B22F 3/24; B22F 2999/00

USPC ..... 148/100–101, 122, 302

See application file for complete search history.

(56) References Cited

U.S. PATENT DOCUMENTS

2008/0223489 A1 * 9/2008 Nagata et al. ..... 148/101
2009/0020193 A1 * 1/2009 Ohta et al. ..... 148/559

(Continued)

FOREIGN PATENT DOCUMENTS

EP 1 643 513 A1 * 4/2006
EP 1 993 112 A1 * 11/2008
WO 2007/102391 * 9/2007

OTHER PUBLICATIONS

Yoshimura et al.; "R-Fe-B Type Rare Earth Sintered Magnet and Process for Production of the Same"; U.S. Appl. No. 12/666,323, filed Dec. 23, 2009.

*Primary Examiner* — Jie Yang

(74) *Attorney, Agent, or Firm* — Keating & Bennett, LLP

(57) ABSTRACT

In an R—Fe—B based rare-earth sintered magnet according to the present invention, at a depth of 20 μm under the surface of its magnet body, crystal grains of an $R_2Fe_{14}B$ type compound have an $(RL_{1-x}RH_x)_2Fe_{14}B$ (where $0.2 \leq x \leq 0.75$) layer with a thickness of 1 nm to 2 μm in their outer periphery. In this case, the light rare-earth element RL is at least one of Nd and Pr, and the heavy rare-earth element RH is at least one element selected from the group consisting of Dy, Ho and Tb.

14 Claims, 6 Drawing Sheets

(a)

(b)

(56) References Cited

U.S. PATENT DOCUMENTS

2010/0182113 A1* 7/2010 Yoshimura et al. ..... 335/302
2010/0231338 A1* 9/2010 Morimoto et al. ..... 335/302
2011/0205006 A1* 8/2011 Odaka et al. ..... 335/302

* cited by examiner (a)

(b)

(a)

(b)

R-FE-B TYPE RARE EARTH SINTERED MAGNET AND PROCESS FOR PRODUCTION OF THE SAME

TECHNICAL FIELD

The present invention relates to an R—Fe—B based rare-earth sintered magnet including crystal grains of an $R_2Fe_{14}B$ type compound (where R is a rare-earth element) as a main phase and a method for producing such a magnet. More particularly, the present invention relates to an R—Fe—B based rare-earth sintered magnet, which includes a light rare-earth element RL (which is at least one of Nd and Pr) as a major rare-earth element R and in which a portion of the light rare-earth element RL is replaced with a heavy rare-earth element RH (which is at least one element selected from the group consisting of Dy, Ho and Tb) and a method for producing such a magnet.

BACKGROUND ART

An R—Fe—B based rare-earth sintered magnet, including an $Nd_2Fe_{14}B$ type compound phase as a main phase, is known as a permanent magnet with the highest performance, and has been used in various types of motors such as a voice coil motor (VCM) for a hard disk drive and a motor for a hybrid car and in numerous types of consumer electronic appliances. When used in motors and various other devices, the R—Fe—B based rare-earth sintered magnet should exhibit thermal resistance that is high enough to withstand an operating environment at an elevated temperature.

The thermal resistance of an R—Fe—B based rare-earth sintered magnet can be increased by raising its coercivity. And as a means for increasing the coercivity of an R—Fe—B based rare-earth sintered magnet, a molten alloy, including a heavy rare-earth element RH as an additional element, may be used. According to this method, the light rare-earth element RL, which is included as a rare-earth element R in an $R_2Fe_{14}B$ phase, is replaced with a heavy rare-earth element RH, and therefore, the magnetocrystalline anisotropy (which is a decisive quality parameter that determines the coercivity) of the $R_2Fe_{14}B$ phase improves. However, although the magnetic moment of the light rare-earth element RL in the $R_2Fe_{14}B$ phase has the same direction as that of Fe, the magnetic moments of the heavy rare-earth element RH and Fe have mutually opposite directions. That is why the remanence $B_r$ would decrease in proportion to the percentage of the light rare-earth element RL replaced with the heavy rare-earth element RH.

Meanwhile, as the heavy rare-earth element RH is one of rare natural resources, its use is preferably cut down as much as possible. For these reasons, the method in which the light rare-earth element RL is entirely replaced with the heavy rare-earth element RH is not preferred.

To get the coercivity increased effectively with the addition of a relatively small amount of the heavy rare-earth element RH, it was proposed that an alloy or compound powder, including a lot of the heavy rare-earth element RH, be added to a main phase material alloy powder including a lot of the light rare-earth element RL and then the mixture be compacted and sintered. According to this method, the heavy rare-earth element RH is distributed a lot in the vicinity of the grain boundary of the $R_2Fe_{14}B$ phase, and therefore, the magnetocrystalline anisotropy of the $R_2Fe_{14}B$ phase can be improved efficiently in the outer periphery (surface region) of the main phase grain. The R—Fe—B based rare-earth sintered magnet has a nucleation-type coercivity generating mechanism. That is why if a lot of the heavy rare-earth element RH is distributed in the outer periphery of the main phase (i.e., near the grain boundary thereof), the magnetocrystalline anisotropy of the entire crystal grain is improved, the nucleation of reverse magnetic domains can be interfered with, and the coercivity increases as a result. At the core of the crystal grains, no light rare-earth element RL is replaced with the heavy rare-earth element RH. Consequently, the decrease in remanence $B_r$ can be minimized there, too.

If this method were actually adopted, however, the heavy rare-earth element RH has an increased diffusion rate during the sintering process (which is carried out at a temperature of 1,000° C. to 1,200° C. on an industrial scale) and could diffuse to reach the core of the crystal grains, too. For that reason, it is not easy to obtain the expected crystal structure.

As another method for increasing the coercivity of an R—Fe—B based rare-earth sintered magnet, a metal, an alloy or a compound including a heavy rare-earth element RH is deposited on the surface of the sintered magnet and then thermally treated and diffused. Then, the coercivity could be recovered or increased without decreasing the remanence so much (see Patent Documents Nos. 1 to 5).

Patent Document No. 1 teaches forming a thin-film layer, including R' that is at least one element selected from the group consisting of Nd, Pr, Dy, Ho and Tb on the surface of a sintered magnet body to be machined and then subjecting it to a heat treatment within either a vacuum or an inert atmosphere, thereby turning a deformed layer on the machined surface into a repaired layer through a diffusion reaction between the thin-film layer and the deformed layer and recovering the coercivity.

Patent Document No. 2 discloses that a metallic element R (which is at least one rare-earth element selected from the group consisting of Y, Nd, Dy, Pr, Ho and Tb) is diffused to a depth that is at least equal to the radius of crystal grains exposed on the uppermost surface of a small-sized magnet while the thin film is being deposited, thereby repairing the damage done on the machined surface and increasing $(BH)_{max}$.

Patent Document No. 3 teaches providing a layer that has higher intrinsic coercivity than the core of the magnet body in the vicinity of the surface of a sintered magnet. Such a layer with high intrinsic coercivity may be formed by depositing a thin-film layer made of a material such as Tb, Dy, Al or Ga on the surface of a sintered magnet by sputtering, for example, and then diffusing that material into a surface region of the sintered magnet through a heat treatment.

Patent Document No. 4 discloses that a film including an element that is selected from the group consisting of Pr, Dy, Tb and Ho is deposited on the surface of an R—Fe—B based magnet by some physical method and then made to diffuse and permeate, thereby achieving high coercivity or high remanence.

Patent Document No. 5 discloses that by depositing a CVD film, consisting mostly of a rare-earth element, on the surface of a magnet with a thickness of 2 mm or less and then subjecting it to a heat treatment, the rare-earth element would diffuse inside the magnet, the machined and damaged layer in the vicinity of the surface could be repaired, and eventually the magnetic properties could be recovered.

Patent Document No. 6 discloses a method of sorbing a rare-earth element to recover the coercivity of a very small R—Fe—B based sintered magnet or its powder. According to the method of Patent Document No. 6, a sorption metal, which is a rare-earth metal such as Yb, Eu or Sm with a relatively low boiling point, and a very small R—Fe—B based sintered magnet or its powder are mixed together, and then the mixture is subjected to a heat treatment to heat it uniformly in a vacuum while stirring it up. As a result of this heat treatment, the rare-earth metal is not only deposited on the surface of the magnet but also diffused inward. Patent Document No. 6 also discloses an embodiment in which a rare-earth metal with a high boiling point such as Dy is sorbed. In such an embodiment that uses Dy, for example, Dy is selectively heated to a high temperature by an induction heating process. However, Dy has a boiling point of 2,560° C. According to Patent Document No. 6, Yb with a boiling point of 1,193° C. should be heated to a temperature of 800° C. to 850° C. but could not be heated sufficiently by normal resistance heating process. Considering this disclosure of Patent Document No. 6, it is presumed that the Dy be heated to a temperature exceeding 1,000° C. to say the least. Patent Document No. 6 also discloses that the temperature of the very small R—Fe—B based sintered magnet and its powder is preferably maintained within the range of 700° C. to 850° C.

Patent Document No. 1: Japanese Patent Application Laid-Open Publication No. 62-074048

Patent Document No. 2: Japanese Patent Application Laid-Open Publication No. 2004-304038

Patent Document No. 3: Japanese Patent Application Laid-Open Publication No. 1-117303

Patent Document No. 4: Japanese Patent Application Laid-Open Publication No. 2005-11973

Patent Document No. 5: Japanese Patent Application Laid-Open Publication No. 2005-285859

Patent Document No. 6: Japanese Patent Application Laid-Open Publication No. 2004-296973

DISCLOSURE OF INVENTION

Problems to be Solved by the Invention

According to any of the conventional techniques disclosed in Patent Documents Nos. 1 through 5, a sintered magnet body has its surface coated with a film of rare-earth metal and then subjected to a heat treatment, thereby diffusing the rare-earth metal inside the magnet. That is why in the surface region of the magnet (with a thickness of several tens of μm as measured from the surface), a big difference in rare-earth metal concentration at the interface between the rare-earth metal film deposited and the sintered magnet body should inevitably generate a driving force to diffuse the rare-earth metal into the main phase as well. Consequently, the remanence $B_r$ drops.

In addition, according to any of these conventional techniques, it is difficult to get the rare-earth metal diffused deep inside the magnet body with a thickness of 3 mm or more. As a result, there would be a big difference in coercivity between the surface region and the inner region of the magnet body.

Also, according to the conventional technique disclosed in Patent Document No. 6, a rare-earth metal such as Dy is heated to, and deposited at, a temperature that is high enough to vaporize it easily. That is why the deposition rate is far higher than the diffusion rate in the magnet, and a thick Dy film is deposited on the surface of the magnet. As a result, as with any of the conventional techniques disclosed in Patent Documents No. 1 to 5, Dy would also inevitably diffuse and reach the vicinity of the main phase in the surface region of the magnet. Consequently, the remanence $B_r$ would drop, too.

Furthermore, the sorption material and the magnet are both heated by induction heating process. That is why it is not easy to heat only the rare-earth metal to a sufficiently high temperature and yet maintain the magnet at a temperature that is low enough to avoid affecting the magnetic properties. As a result, the magnet will often have a powder state or a very small size and is not easily subjected to the induction heating process in either case.

On top of that, according to the methods of Patent Documents Nos. 1 through 6, the rare-earth metal is also deposited a lot on unexpected portions of the deposition system (e.g., on the inner walls of the vacuum chamber) other than the magnet during the deposition process, which is against the policy of saving a heavy rare-earth element that is one of rare and valuable natural resources.

It is therefore an object of the present invention to provide an R—Fe—B based rare-earth sintered magnet in which the heavy rare-earth element RH has hardly caused intragrain diffusion (i.e., volume diffusion) into main phase crystal grains) but is distributed only in the outer periphery (i.e., in the vicinity of the grain boundary) and of which the coercivity has been increased deeper inside almost without decreasing the remanence.

Means for Solving the Problems

An R—Fe—B based rare-earth sintered magnet according to the present invention includes an R—Fe—B based rare-earth sintered magnet body that includes, as a main phase, crystal grains of an $R_2Fe_{14}B$ type compound, including a light rare-earth element RL (which is at least one of Nd and Pr) as a major rare-earth element R, and a heavy rare-earth element RH (which is at least one element selected from the group consisting of Dy, Ho and Tb). At a depth of 20 μm under the surface of the R—Fe—B based rare-earth sintered magnet body, the crystal grains of the $R_2Fe_{14}B$ type compound have an RH diffused layer ($(RL_{1-x}RH_x)_2Fe_{14}B$ (where $0.2 \leq x \leq 0.75$) layer) with an average thickness of 2 μm or less in their outer periphery. On the other hand, at a depth of 500 μm under the surface of the R—Fe—B based rare-earth sintered magnet body, the crystal grains of the $R_2Fe_{14}B$ type compound have an RH diffused layer with an average thickness of 0.5 μm or less in their outer periphery.

In one preferred embodiment, the R—Fe—B based rare-earth sintered magnet body has a size of 1 mm to 4 mm as measured in a thickness direction. A difference $\Delta H_{cJ}1$ in coercivity between the entire R—Fe—B based rare-earth sintered magnet body and the rest of the R—Fe—B based rare-earth sintered magnet body, from which a surface portion has been removed by 200 μm as measured from its surface, is 150 kA/m or less.

In another preferred embodiment, the R—Fe—B based rare-earth sintered magnet body has a size of more than 4 mm in the thickness direction. A surface region of the R—Fe—B based rare-earth sintered magnet body, which has a thickness of 1 mm as measured from its surface, includes a first layer portion with a thickness of 500 μm as measured from the surface and a second layer portion that is located deeper inside the R—Fe—B based rare-earth sintered magnet body than the first layer portion is and that has a thickness of 500 μm. A difference $\Delta H_{cJ}2$ in coercivity between the first and second layer portions is 300 kA/m or less.

In still another preferred embodiment, the RH diffused layer at the depth of 500 μm under the surface of the R—Fe—B based rare-earth sintered magnet body has the composition $(R_{1-x}RH_x)_2Fe_{14}B$ (where $0.2 \leq x \leq 0.75$).

In yet another preferred embodiment, in a region of the R—Fe—B based rare-earth sintered magnet body between the depths of 20 μm and 500 μm under its surface, the crystal grains of the $R_2Fe_{14}B$ type compound have an RH diffused layer in their outer periphery. The greater the depth under the surface of the R—Fe—B based rare-earth sintered magnet body, the thinner the RH diffused layer gets in the outer periphery of the crystal grains of the $R_2Fe_{14}B$ type compound.

In yet another preferred embodiment, the $(RL_{1-x}RH_x)_2Fe_{14}B$ layer has a uniform composition in which x has a dispersion of 10% or less at least within a single crystal grain.

In yet another preferred embodiment, at the depth of 20 μm under the surface of the R—Fe—B based rare-earth sintered magnet body, the thickness of the $(R_{1-x}RH_x)_2Fe_{14}B$ (where $0.2 \leq x \leq 0.75$) layer in the crystal grains of the $R_2Fe_{14}B$ type compound is 20% or less of the average grain size of the crystal grains of the $R_2Fe_{14}B$ type compound.

In yet another preferred embodiment, in the crystal grains of the $R_2Fe_{14}B$ type compound at the depth of 20 μm under the surface of the R—Fe—B based rare-earth sintered magnet body, the concentration of RH in the $(RL_{1-x}RH_x)_2Fe_{14}B$ (where $0.2 \leq x \leq 0.75$) layer is at least 6.0 mass % greater than that of RH at the core of the crystal grains.

In yet another preferred embodiment, the magnet has an RH-RL-O compound in at least one grain boundary triple junction, which is located at a depth of 100 μm or less under the surface of the R—Fe—B based rare-earth sintered magnet body.

In this particular preferred embodiment, in at least one of the crystal grains of the $R_2Fe_{14}B$ type compound that are located at the depth of 100 μm or less under the surface of the R—Fe—B based rare-earth sintered magnet body, the concentration of RH in the $(RL_{1-x}RH_x)_2Fe_{14}B$ (where $0.2 \leq x \leq 0.75$) layer is smaller than that of the RH-RL-O compound of a grain boundary layer, which surrounds the crystal grain of the $R_2Fe_{14}B$ type compound, but greater than that of the rest of the grain boundary layer other than the RH-RL-O compound.

A method for producing an R—Fe—B based rare-earth sintered magnet according to the present invention includes the steps of: (a) providing an R—Fe—B based rare-earth sintered magnet body, which includes, as a main phase, crystal grains of an $R_2Fe_{14}B$ type compound including a light rare-earth element RL (which is at least one of Nd and Pr) as a major rare-earth element R; (b) diffusing a heavy rare-earth element RH (which is at least one element selected from the group consisting of Dy, Ho and Tb) inside the R—Fe—B based rare-earth sintered magnet body; and (c) removing a surface portion of the R—Fe—B based rare-earth sintered magnet body, in which the heavy rare-earth element RH has been diffused, to a depth of 5 μm to 500 μm. The step (b) includes the steps of: (b1) arranging a bulk body including the heavy rare-earth element RH (which is at least one element selected from the group consisting of Dy, Ho and Tb), along with the R—Fe—B based rare-earth sintered magnet body, in a processing chamber; and (b2) heating the bulk body and the R—Fe—B based rare-earth sintered magnet body together to a temperature of 700° C. to 1,000° C., thereby diffusing the heavy rare-earth element RH inside the R—Fe—B based rare-earth sintered magnet body while supplying the heavy rare-earth element RH from the bulk body onto the surface of the R—Fe—B based rare-earth sintered magnet body simultaneously.

In one preferred embodiment, the step (b2) includes arranging the bulk body and the R—Fe—B based rare-earth sintered magnet body out of contact with each other in the processing chamber and leaving an average gap of 0.1 mm to 300 mm between them.

In another preferred embodiment, the step (b2) includes setting a difference in temperature between the R—Fe—B based rare-earth sintered magnet body and the bulk body within 20° C.

In still another preferred embodiment, the step (b2) includes adjusting the pressure of an atmospheric gas in the processing chamber within the range of $10^{-5}$ Pa through 500 Pa.

In yet another preferred embodiment, the step (b2) includes maintaining the temperatures of the bulk body and the R—Fe—B based rare-earth sintered magnet body within the range of 700° C. through 1,000° C. for 10 to 600 minutes.

In yet another preferred embodiment, the method further includes, after the step (b2), the step (b3) of conducting a heat treatment at a temperature of 700° C. to 1,000° C. for 1 to 60 hours.

In this particular preferred embodiment, the step (b3) is performed in the processing chamber in which the bulk body is arranged with the pressure of the atmospheric gas in the processing chamber adjusted to at least 500 Pa.

In an alternative preferred embodiment, the step (b3) is performed in either the processing chamber from which the bulk body has already been unloaded or in another processing chamber from which the bulk body is absent.

Effects of the Invention

According to the present invention, a sintered magnet body, which has had its coercivity $H_{cJ}$ increased, but its remanence $B_r$ decreased, by diffusing a heavy rare-earth element RH (which is at least one element selected from the group consisting of Dy, Ho and Tb) inside the sintered magnet body through the surface thereof by evaporation diffusion process (i.e., the process performed in the step (b)), has its portion near the surface (which will be sometimes referred to herein as a "surface portion") removed.

Since the sintered magnet body of the present invention includes, as a main phase, crystal grains of an $R_2Fe_{14}B$ type compound including a light rare-earth element RL (which is at least one of Nd and Pr) as a major rare-earth element R, the heavy rare-earth element RH that has been diffused inside the sintered magnet body through its surface by the evaporation diffusion process has reached the outer periphery of the crystal grains of the $R_2Fe_{14}B$ type compound by way of the grain boundary phase (that is an R-rich phase) of the crystal grains of the $R_2Fe_{14}B$ type compound.

According to the evaporation diffusion process, the concentration of the heavy rare-earth element RH can be increased efficiently in the outer periphery of main phase crystal grains. In crystal grains of the $R_2Fe_{14}B$ type compound in the surface portion of the sintered magnet body, however, the heavy rare-earth element RH tends to diffuse deeper inside, or reach closer to the core, of the crystal grains, compared to crystal grains of the $R_2Fe_{14}B$ type compound that are located deeper than the surface portion. That is why in the surface portion of the sintered magnet body, the remanence $B_r$ will decrease more easily than deeper inside the sintered body.

According to the present invention, that surface portion of the sintered magnet body is removed after the diffusion. As will be described in detail later, according to the evaporation diffusion process, the heavy rare-earth element RH will diffuse and permeate deeper inside the sintered magnet body. That is why even if the surface portion of the magnet body was removed, the coercivity would hardly decrease compared to the magnet body that still has that surface portion. Consequently, an R—Fe—B based sintered magnet body, of which the coercivity $H_{cJ}$ has increased in a broader range (i.e., from the surface through the deeper region of the sintered magnet body) almost without decreasing the remanence $B_r$ compared to the sintered magnet body in which the heavy rare-earth element RH has not diffused yet, can be obtained.

DESCRIPTION OF REFERENCE NUMERALS

Figure 1:
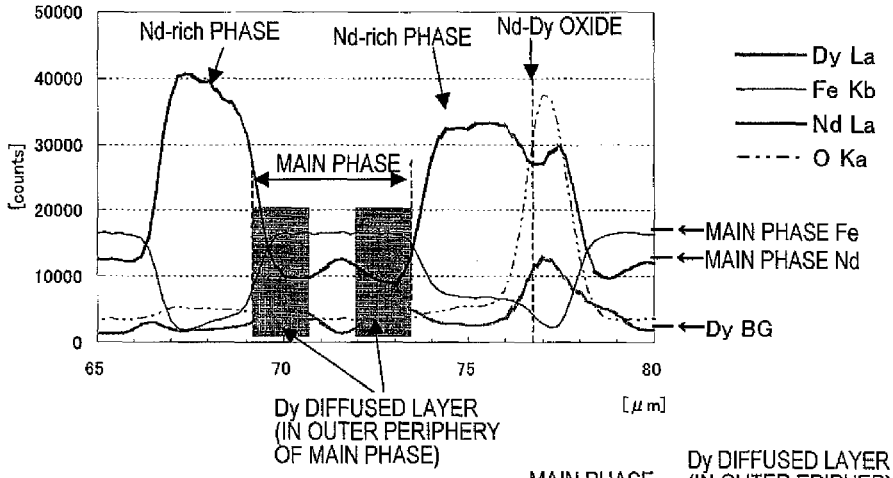
FIG. 1(*a*) is a graph showing the results of a line analysis that was carried out, using an EPMA, on the crystal structure of an R—Fe—B based rare-earth sintered magnet according to the present invention, and FIG. 1(*b*) is a schematic representation illustrating the portion on which the analysis of FIG. 1(*a*) was carried out.
Figure 1:
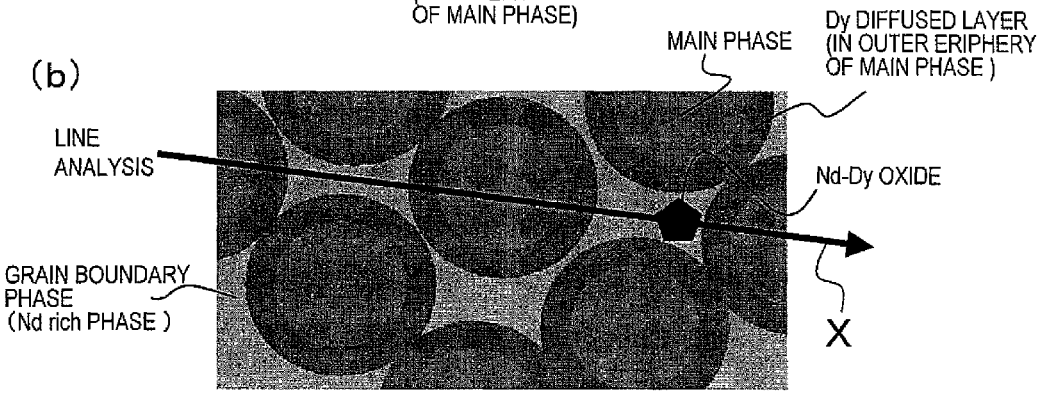

2 sintered magnet body
4 RH bulk body
6 processing chamber
8 net made of Nb

BEST MODE FOR CARRYING OUT THE INVENTION

In an R—Fe—B based rare-earth sintered magnet according to the present invention, at a depth of 20 μm under the surface of its sintered magnet body, crystal grains of an $R_2Fe_{14}B$ type compound have an $(RL_{1-x}RH_x)_2Fe_{14}B$ (where $0.2 \leq x \leq 0.75$) layer with an average thickness of 2 μm or less in their outer periphery. In this case, the light rare-earth element RL is at least one of Nd and Pr and the heavy rare-earth element RH is at least one element selected from the group consisting of Dy, Ho and Tb. If the mole fraction x were less than 0.2, the coercivity could not be increased as expected. Also, according to an evaporation diffusion process, it is difficult to diffuse RH and raise its concentration in the outer periphery of main phase crystal grains to the point that x exceeds 0.75.

As used herein, the "surface of the sintered magnet body" means the surface of the sintered magnet body, from which its surface portion has already been removed after the heavy rare-earth element RH has been introduced into the sintered magnet body from outside of the sintered magnet body, i.e., the machined surface (which may be a ground or polished surface). Therefore, if the "surface of the sintered magnet body" is covered with a coating of a metal or a resin, the "surface of the sintered magnet body" is not the surface of such a coating but the surface that is now covered with that coating.

Also, in the R—Fe—B based rare-earth sintered magnet of the present invention, at a depth of 500 μm under the surface of the sintered magnet body, the crystal grains of the $R_2Fe_{14}B$ type compound have an RH diffused layer with a thickness of 0.5 μm or less (which will also be referred to herein as a "layer with an increased RH concentration") in their outer periphery.

An R—Fe—B based sintered magnet according to the present invention can be obtained by diffusing the heavy rare-earth element RH inward from the surface of an R—Fe—B based sintered magnet body by evaporation diffusion process and then removing a surface portion of the magnet body to a depth of 5 μm or more.

First of all, the crystal structure of an R—Fe—B based rare-earth sintered magnet according to the present invention will be described in detail with reference to FIG. 1. Specifically, FIG. 1(*a*) is a graph showing the results of a line analysis that was carried out on the crystal structure of an R—Fe—B based rare-earth sintered magnet according to the present invention at a depth of around 20 μm under its surface (from which the surface portion had already been removed) using an electron probe micro-analyzer (which will be abbreviated herein as an "EPMA"). On the other hand, FIG. 1(*b*) is a schematic representation illustrating the crystal structure on which the line analysis was carried out. And the results shown in FIG. 1(*a*) were obtained by carrying out a line analysis on the portion indicated by the arrowed line X shown in FIG. 1(*b*). The legends shown on the right-hand side of the graph of FIG. 1(*a*) (i.e., "main phase Fe", "main phase Nd" and "Dy BG (background)") represent the respective intensities of Fe, Nd and Dy that were included in the main phase that had not been subjected to the diffusion process yet.

As used herein, the "main phase" refers to crystal grains of an $R_2Fe_{14}B$ type compound (where R is a rare-earth element), the "main phase Fe" represents the intensity of Fe in the crystal grains of the $R_2Fe_{14}B$ type compound, and the "main phase Nd" represents the intensity of Nd in the crystal grains of the $R_2Fe_{14}B$ type compound.

As can be seen from FIGS. 1(*a*) and 1(*b*), in the outer periphery of the main phase, confirmed was the presence of a compound layer in which the concentration of Nd decreased, but the concentration of Dy increased, compared to the main phase yet to be subjected to the diffusion process (which will be referred to herein as a "Dy diffused layer"). The Dy diffused layer had a thickness of approximately 1 μm. And this compound layer has the composition $(RL_{1-x}RH_x)_2Fe_{14}B$ (where $0.2 \leq x \leq 0.75$).

The concentration of Dy at the core of the main phase agreed with the "Dy BG" level shown in FIG. 1(*a*). That is to say, the concentration of Dy at the core of the main phase did not increase from the concentration of Dy in the main phase yet to be subjected to the diffusion process, and no Dy that had been introduced by diffusion from the surface of the magnet body was detected. Also, at the grain boundary triple junction (as indicated by the solid pentagon shown in FIG. 1(*b*)), there was an Nd—Dy oxide, which will be described in detail later.

Next, the Dy diffused layer will be described in further detail with reference to FIG. 2.

Figure 2:
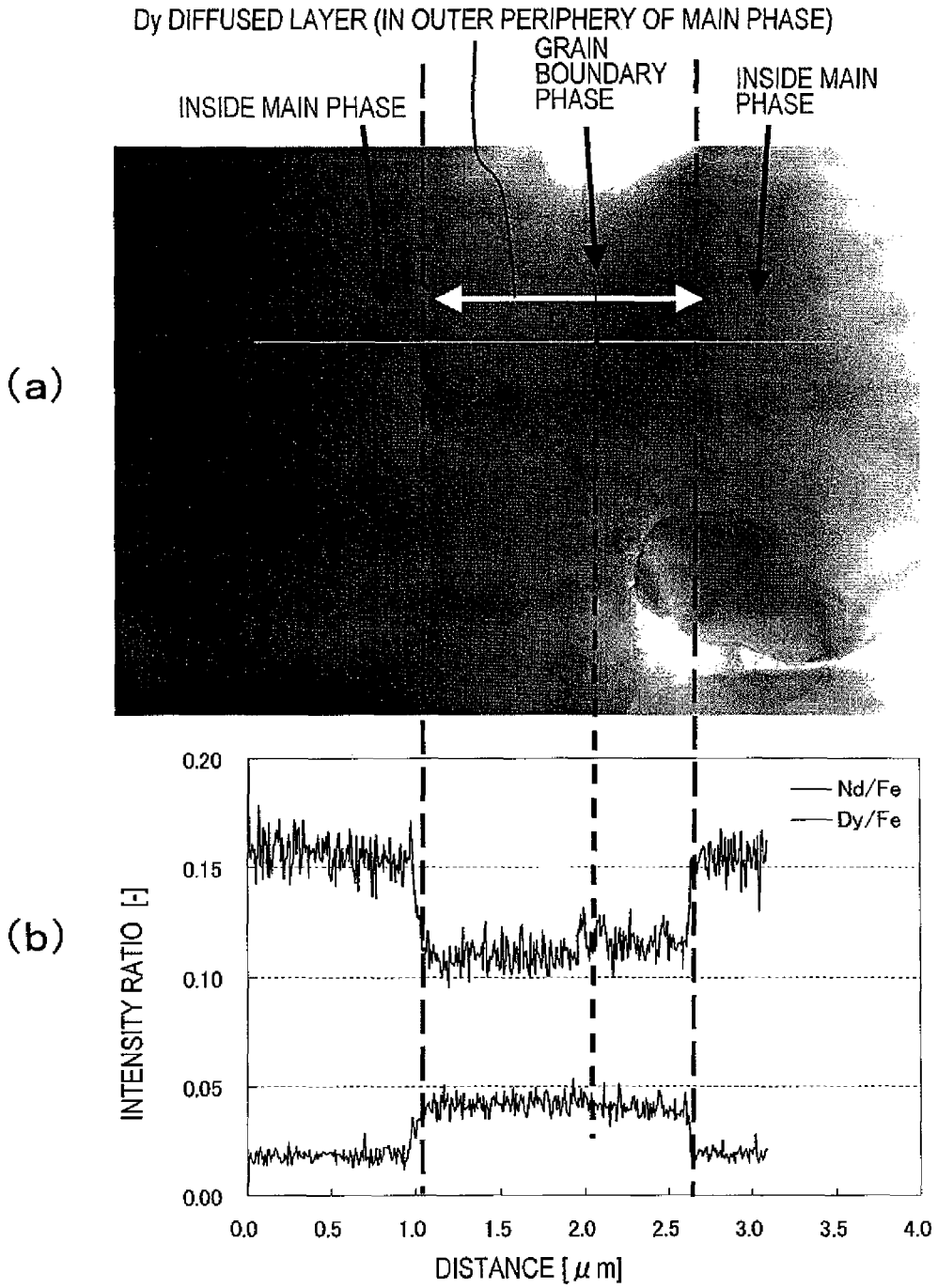
FIG. 2(*a*) is a TEM photograph representing a portion of an R—Fe—B based rare-earth sintered magnet according to the present invention at a depth of approximately 20 μm under the surface (from which the surface portion had already been removed) and in the vicinity of a grain boundary triple junction, and FIG. 2(*b*) is a graph showing the results of a line analysis that was carried out on the portion indicated by the thin straight line in FIG. 2(*a*) using a TEM.

FIG. 2(*a*) is a transmission electron microscope (TEM) photograph representing the crystal structure of an R—Fe—B based rare-earth sintered magnet according to the present invention at a depth of approximately 20 μm under the surface (from which the surface portion had already been removed) and in the vicinity of a grain boundary triple junction. The triangular region shown on the lower right hand side of FIG. 2(*a*) is the grain boundary triple junction, in which the Nd—Dy oxide was present. There was a thin grain boundary layer over the grain boundary triple junction and a diffusion layer with a constant Dy concentration was present on both sides of the grain boundary layer.

FIG. 2(*b*) is a graph showing the results of a line analysis that was carried out on the portion indicated by the thin straight line in FIG. 2(*a*) using a TEM. The results shown in FIG. 2(*b*) include some analysis noise but still reveal that the Dy diffused layer in the outer periphery of the main phase had no concentration gradients and had an almost uniform composition $(RL_{1-x}RH_x)_2Fe_{14}B$ (where $0.2 \leq x \leq 0.75$), where x is substantially constant in at least one crystal grain.

In the Dy diffused layer described above, x preferably has a dispersion of 10% or less. It was confirmed, by separately measuring its dispersion by point analysis using a TEM, that this Dy diffused layer had an x dispersion of 10% or less, as will be described later for specific examples of the present invention.

The crystal structure of the sintered magnet of the present invention at a depth of around 20 μm has been described in detail with reference to FIGS. 1(*a*), 1(*b*), 2(*a*) and 2(*b*). Next, the cross-sectional structure of a region of the sintered magnet body of the present invention from a depth of 0 μm through a depth of 250 μm will be described with reference to FIGS. 3 and 4.

Figure 3:
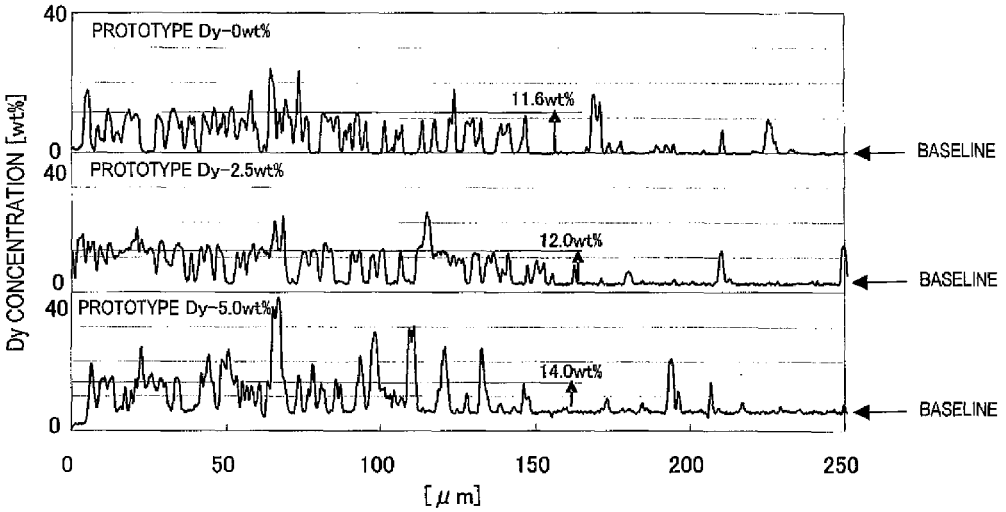
FIG. 3 shows the results of an EPMA line analysis that was carried out on Samples A1 to A3 representing specific examples of the present invention.
Figure 4:
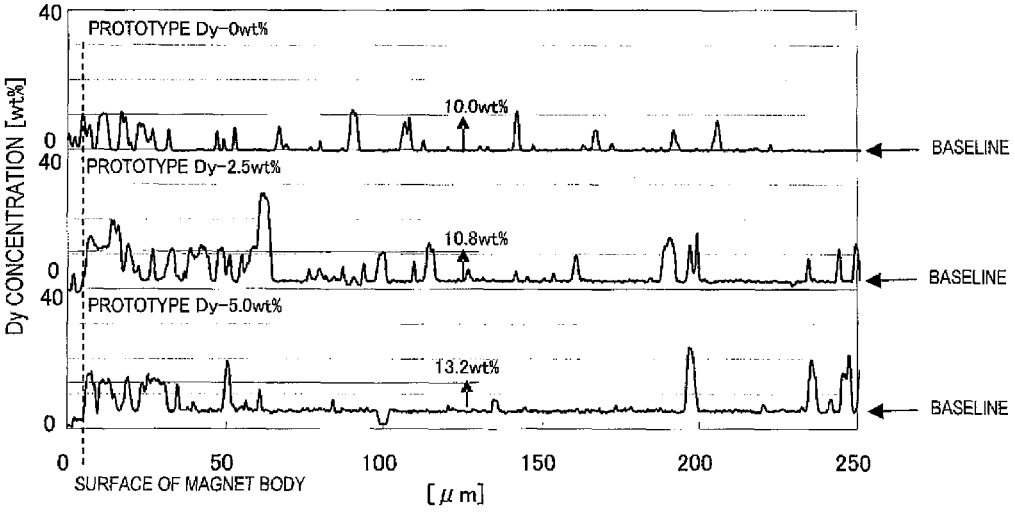
FIG. 4 shows the results of an EPMA line analysis that was carried out on Samples B1 to B3 representing other specific examples of the present invention.

FIGS. 3 and 4 are graphs showing how the Dy concentration varied in the depth direction in such a region of an R—Fe—B based rare-earth sintered magnet from a depth of 0 μm through a depth of 250 μm, in which Dy had already been diffused but from which the surface portion had not been removed yet. In FIGS. 3 and 4, the abscissa represents the depth as measured from the surface of the magnet and the ordinate represents the Dy concentration (in wt %). These graphs were drawn based on the results of a line analysis that had been carried out in the depth direction on the cross section of that region from the surface thereof using an EPMA. Although the line analysis using an EPMA was also carried out on several elements other than Dy, only the Dy concentrations are shown in FIGS. 3 and 4 for the sake of simplicity.

The data shown in FIGS. 3 and 4 were collected under the same conditions except that a heat treatment was carried out on the sintered magnet body under mutually different sets of conditions during the Dy evaporation diffusion process. Specifically, the data shown in FIG. 3 was obtained by performing the Dy evaporation diffusion process with the heat treatment carried out at 900° C. for 120 minutes, while the data shown in FIG. 4 was obtained by performing the Dy evaporation diffusion process with the heat treatment carried out at 850° C. for 240 minutes. Under these two sets of heat treatment conditions, data was collected on sintered magnet bodies including 0 wt %, 2.5 wt %, and 5.0 wt % of Dy before being subjected to the diffusion process. In each of FIGS. 3 and 4, the data about the sintered magnet bodies including 0 wt %, 2.5 wt %, and 5.0 wt % of Dy, respectively, are shown in this order (top to bottom). The details of Specific Example #1 will be described later.

The line analysis with the EPMA was carried out using EPM1610 produced by Shimadzu Corporation under the measuring conditions shown in the following Table 1. On the other hand, the analysis with the TEM was carried out using CM200ST produced by FEI Company under measuring conditions including 5 seconds per point and a step width of 7 nm.

TABLE 1

| | |
|---|---|
| Step width | 0.2 μm |
| Beam current | 100 nA |
| Number of elements under measurement | 5 |
| Beam diameter | 1 μmϕ |
| Scan duration | 1 second |
| Accelerating voltage | 15 kV |

As already described with reference to FIGS. 1(*a*), 1(*b*), 2(*a*) and 2(*b*), the layer including the heavy rare-earth element RH that had been introduced by evaporation diffusion process was present in the outer periphery of the main phase crystal grains and had an almost uniform composition. In FIGS. 3 and 4, the level (or the height) of each of the dashed lines running horizontally indicates the concentration of Dy included in the RH (Dy) diffused layer of its associated sample sintered magnet body. It should be noted that the levels (or heights) of those dashed lines were set by detecting the concentration of Dy in the Dy diffused layer based on the intensity of Dy Lα that had been measured with an EPMA.

In FIGS. 3 and 4, each of the baselines represents the concentration of Dy that was included in the main phase yet to be subjected to the diffusion process. Also, in FIGS. 3 and 4, peaks approximately on a level with the Dy concentration of the Dy diffused layer, which is indicated by the dashed lines, represent a region with an RH (Dy) diffused layer (i.e., the outer periphery of the main phase). On the other hand, peaks on the baseline represent either a region in which no Dy was introduced at all as a result of the diffusion process or a region in which the diffused layer was too thin to detect Dy. In other words, that region corresponds to an inner region of a main phase grain that no Dy reached by diffusion, a main phase grain with a Dy diffused layer that was too thin to detect any Dy, or a grain boundary phase.

Furthermore, peaks exceeding the height indicated by the dashed lines represent a region where an Nd—Dy oxide was present at a grain boundary triple junction. It should be noted that it was determined, based on the concentrations of Nd and oxygen (not shown) that were also measured with an EPMA, which peaks represent what regions.

According to the results shown in FIG. 3, in the surface region of the magnet with a thickness of approximately 100 μm or less as measured from the surface of the magnet body, the respective peaks have broad widths and almost no peaks are on a level with the baselines. This means that in the surface region of the magnet with a thickness of approximately 100 μm or less, there were a lot of main phase crystal grains in which Dy had diffused almost to their core.

Meanwhile, it can also be seen that the deeper inside the magnet the measuring point, the narrower the peak widths and that a lot of peaks are on a level with the baselines once the depth has exceeded 100 μm. This means that the number of crystalline phases, in which the intragrain diffusion of Dy had not reached the core of the crystal grains, has increased.

And in a region with a depth exceeding approximately 150 μm, there are almost no peaks. This means that the intragrain diffusion of Dy occurred so rarely there that no thickness of the Dy diffused layer was detected anymore by this analysis. The present inventors confirmed, by carrying out an analysis on Nd and O at the same time, that a few peaks that were detected here and there in that region represent the presence of an Nd—Dy oxide that has also been confirmed in FIG. 1(*b*).

As described above, in the R—Fe—B based rare-earth sintered magnet according to the present invention, the deeper under the surface of the sintered magnet body the point of measurement is, the thinner the RH diffused layer (i.e., the $(RL_{1-x}RH_x)_2Fe_{14}B$ (where $0.2 \leq x \leq 0.75$) layer) described above gets.

In the example shown in FIG. 4, significant intragrain diffusion was certainly detected in the surface portion (to a depth of approximately 20-30 μm) but the Dy diffused layer that could be present in the outer periphery of main phase crystal grains was no longer detected in a region with a depth of approximately 50 μm or more (i.e., inside the sintered magnet body). This is probably because in the example shown in FIG. 4, the diffusion process was carried out at a lower temperature and for a longer time compared to the example shown in FIG. 3, and therefore, the grain boundary diffusion advanced at a higher rate than the intragrain diffusion, thus making the intragrain diffusion much less noticeable.

An RL-RH oxide such as the Nd—Dy oxide described above is present at the grain boundary triple junction of the R—Fe—B based rare-earth sintered magnet body of the present invention. Such an oxide is preferably present in at least one grain boundary triple junction, which is located at a depth of 100 μm or less under the surface of the sintered magnet body, and preferably has a higher RH concentration than any other portion. Except this oxide, however, the grain boundary layer (which is an RL-rich layer) has a lower RH (Dy) concentration than the RL-RH oxide or the RH diffused phase in the outer periphery of the main phase surrounded with the grain boundary phase.

The grain boundary of the R—Fe—B based rare-earth sintered magnet body of the present invention has almost no heavy rare-earth element RH, except that RL-RH oxide, and has a lower RH concentration than the RH diffused layer. On the other hand, in the conventional magnets disclosed in Patent Documents Nos. 1 through 6, for example, the heavy rare-earth element RH is included a lot on the grain boundary but a little in the main phase as described in Patent Document No. 4. Such a difference in the distribution of the heavy rare-earth element RH would probably be caused by a difference in diffusion process.

Also, in crystal grains of the $R_2Fe_{14}B$ type compound at a depth of 20 μm under the surface of the sintered magnet body, the difference in the concentration of Dy between the core of those crystal grains and their peripheral $(RL_{1-x}RH_x)_2Fe_{14}B$ (where $0.2 \leq x \leq 0.75$) layer corresponds to the amount of Dy that has been introduced by diffusion, and is preferably 6.0 mass % or more. In this case, 6.0 mass % substantially corresponds to the mole fraction x of 0.2 in the compositional formula described above.

According to the present invention, the intragrain diffusion has hardly occurred at the depth of 20 μm under the surface of the sintered magnet body, from which the surface portion has already been removed, and the $(RL_{1-x}RH_x)_2Fe_{14}B$ (where $0.2 \leq x \leq 0.75$) layer that could be present in the outer periphery of the crystal grains of the $R_2Fe_{14}B$ type compound will have a thickness that is at most 20% as large as the average grain size of the crystal grains of the $R_2Fe_{14}B$ type compound.

Figure 5:
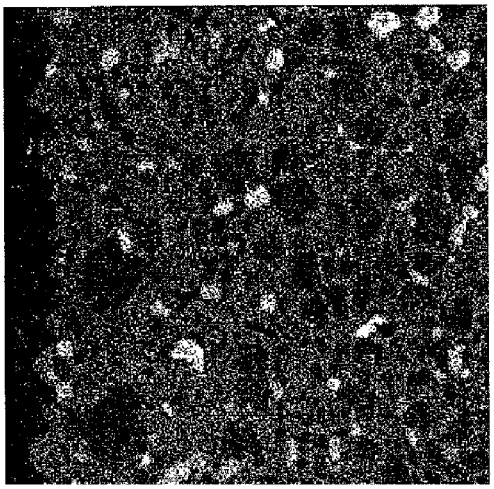
FIGS. 5(*a*) and 5(*b*) show Dy L α characteristic X-ray images on a cross section of an R—Fe—B based rare-earth sintered magnet according to the present invention, from which a surface portion has not been removed yet and from which the surface portion has already been removed, respectively.
Figure 5:
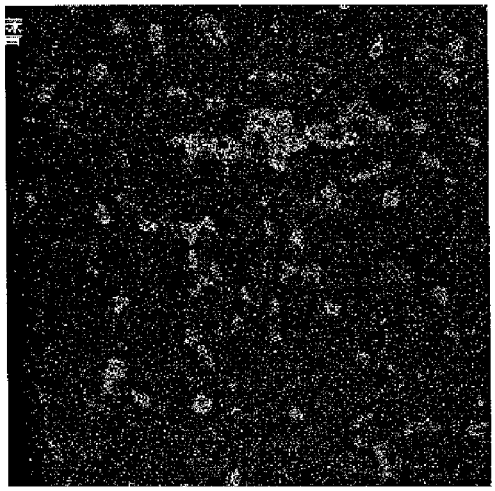

FIG. 5(*a*) shows a Dy Lα characteristic X-ray image on a cross section of a sample magnet, which had had a Dy concentration of 5.0 wt % before being subjected to the diffusion process but which had already been subjected to the diffusion process, from its surface to a depth of approximately 80 μm under the surface. As can be seen from FIG. 5(*a*), the intragrain diffusion rather advanced in the surface region of the magnet body, which is in agreement with the results shown in FIG. 3. Portions with a high Dy Lα intensity at the grain boundary triple junctions (i.e., relatively bright portions shown in FIG. 5(*a*)) represent Nd—Dy oxides.

On the other hand, FIG. 5(*b*) is a Dy Lα characteristic X-ray image on a cross section of the same magnet as the one shown in FIG. 5(*a*), from which the surface portion had already been removed to a depth of 150 μm as measured from its surface, though. The Dy Lα characteristic X-ray image shown in FIG. 5(*b*) corresponds to that of a magnet body, from which the surface portion has not been removed yet, in the range from a depth of 150 μm through a depth of 230 μm.

Once the surface portion has been removed to the depth of approximately 150 μm as in the sample shown in FIG. 5(*b*), most of Dy detected, if any, will either be Dy that was already included in the magnet before the diffusion process or come from the Nd—Dy oxide at the grain boundary triple junction, and the intragrain diffusion of Dy is almost negligible, which is also in agreement with the results shown in FIG. 3.

As described above, in an R—Fe—B based rare-earth sintered magnet, the heavy rare-earth element RH distributed in the outer periphery of its main phase (i.e., in the vicinity of the grain boundary) would certainly contribute to increasing the coercivity but the heavy rare-earth element RH that has diffused to reach the core of crystal grains would hardly contribute to increasing the coercivity. In that RH diffused layer, the coercivity has certainly been increased significantly due to the improvement of the magnetocrystalline anisotropy but the remanence ($B_r$) would have decreased because the magnetic moment of the heavy rare-earth element RH and that of Fe have mutually opposite directions. That is why the overall remanence ($B_r$) of the resultant magnet would somewhat decrease, too.

As can be seen from FIGS. 3, 4 and 5(*a*), the crystal grains that are located relatively close to the surface of the magnet body let Dy diffuse and reach their core, and include a lot of heavy rare-earth element RH that would just decrease the remanence without contributing to increasing the coercivity. In the prior art, however, people believed that even in such a region close to the surface of the magnet body, the crystal grains as a whole should have increased coercivity. That is to say, as can be seen from the foregoing description, it has been widely believed that the deeper inside the magnet, the smaller the amount of RH diffused and reached, and therefore, the less effectively the coercivity should be increased.

That is why in the prior art, those skilled in the art have believed it important to diffuse the heavy rare-earth element RH only in the outer periphery of the main phase in order to increase the overall coercivity without further decreasing the remanence. And they have never dreamed of removing the heavy rare-earth element RH on purpose from the surface region of the magnet because the heavy rare-earth element RH, which has been introduced by diffusing rare and expensive Dy intentionally, does contribute to increasing the coercivity in the crystal grains as a whole.

However, the present inventors discovered that when we dared to remove the surface portion in which the coercivity had certainly been increased but in which the intragrain diffusion had also advanced considerably, only the decrease in remanence $B_r$ could be minimized with the increase in the coercivity $H_{cJ}$ of the overall magnet almost kept intact, contrary to such a popular misconception.

With this discovery, to find how deep the surface portion should be removed to avoid decreasing the remanence, the present inventors carried out investigations to know how the magnetic properties of the sintered magnet body, from which the surface portion had been removed, were affected by the thickness of the surface portion removed. As a result, although the best thickness of the surface portion to remove would differ according to the diffusion conditions, the present inventors discovered that the remanence that had once been decreased due to the addition of RH recovered if the surface portion were removed to a depth at which there was no RH that had been introduced by diffusion into the core of the main phase (specifically, until the RH diffused layer at a depth of 20 μm under the surface came to have a thickness of 2 μm or less).

Also, these results of our investigation revealed that those portions in which almost no peaks representing the presence of the Dy diffused layer inside the magnet were observed and in which Dy was just detected as an oxide in the grain boundary triple junction in FIGS. 3 and 4 would have been in an ideal state in which Dy had diffused very thinly in the outer periphery of the main phase crystal grains. As will also be described later for experimental examples, in the R—Fe—B based rare-earth sintered magnet of the present invention, even at such a depth of 500 μm under the surface of the sintered magnet body, the crystal grains of the $R_2Fe_{14}B$ type compound still had an RH diffused layer (i.e., with an increased RH concentration), which preferably has the composition $(RL_{1-x}RH_x)_2Fe_{14}B$ (where $0.2 \leq x \leq 0.75$) and has an average thickness of 0.5 μm or less.

If the surface portion in which the intragrain diffusion of Dy has advanced considerably is removed, then the Dy diffused layer will be present a lot in the outer periphery of the main phase. As a result, a high-performance R—Fe—B based rare-earth sintered magnet, which has had its coercivity significantly increased almost without decreasing its remanence, can be obtained.

Figure 6:
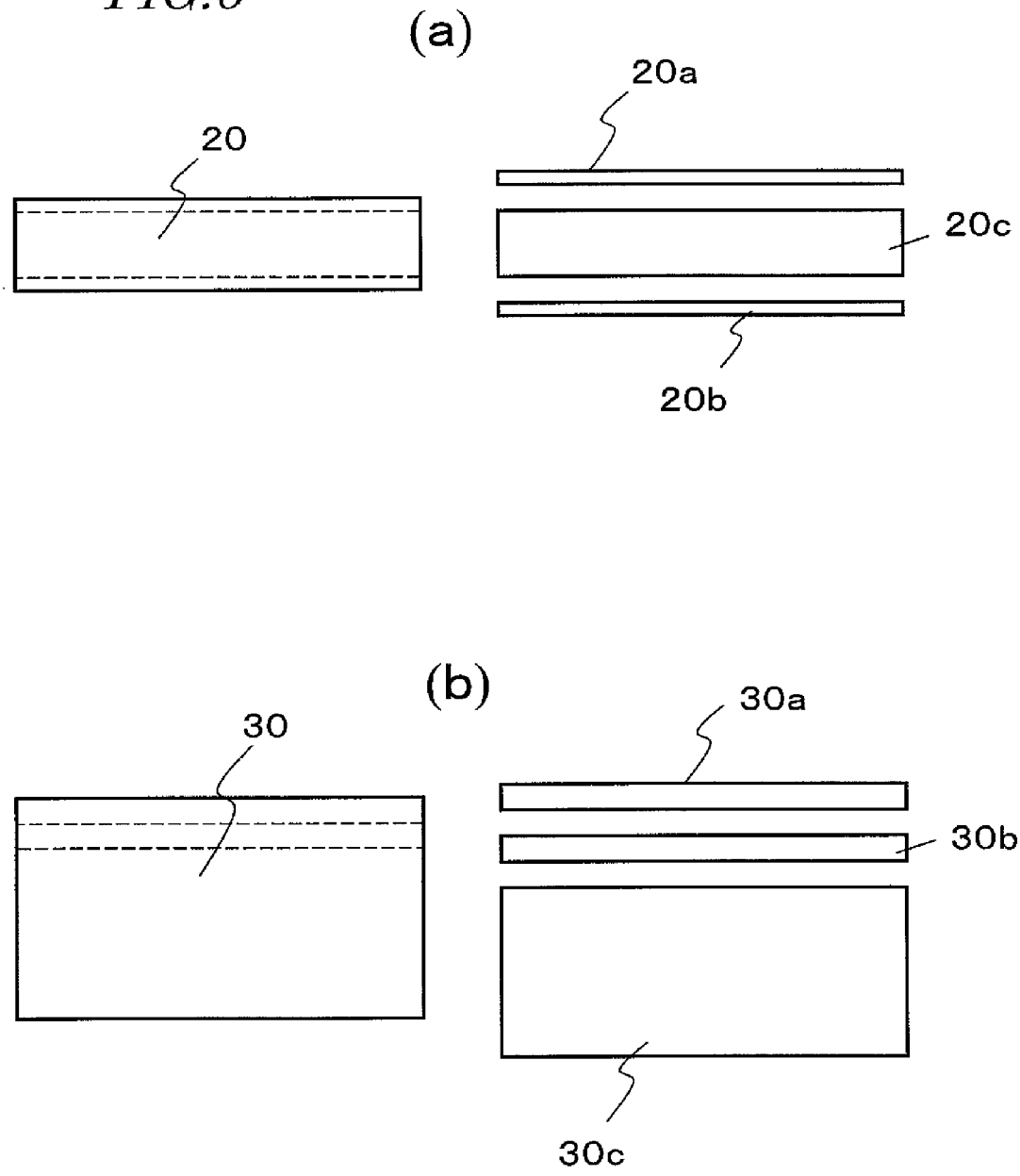
FIGS. 6(*a*) and 6(*b*) are schematic representations illustrating how to estimate a variation in coercivity.

If the sintered magnet body of the present invention (from which the surface portion has already been removed) has an (average) size of 1 mm to 4 mm in the thickness direction (i.e., the direction that intersects with a surface with the broadest area at right angles), then the difference $\Delta H_{cJ}1$ in coercivity between the overall sintered magnet body and the rest of the sintered magnet body, from which the surface portions have been further removed by 200 μm, becomes 150 kA/m or less. This point will be described with reference to FIG. 6(*a*). As shown in FIG. 6(*a*), by removing surface portions 20*a* and 20*b*, each having a thickness of 200 μm, from the upper and lower surfaces of the sintered magnet body 20, respectively, the remaining portion 20*c* of the sintered magnet body 20 is obtained. And the difference $\Delta H_{cJ}1$ in coercivity between that remaining portion 20*c* and the overall sintered magnet body 20, from which those surface portions have not been removed yet, becomes 150 kA/m or less.

If the sintered magnet body has a size of more than 4 mm in the thickness direction, a surface region with a thickness of 1 mm as measured from the surface of the sintered magnet body is preferably divided into a first layer portion with a thickness of 500 μm as measured from the surface and a second layer portion that also has a thickness of 500 μm and that is located deeper inside the sintered magnet body than the first layer portion. In that case, the difference $\Delta H_{cJ}2$ in coercivity between the first and second layer portions becomes 300 kA/m or less. This point will be described with reference to FIG. 6(*b*). As shown in FIG. 6(*b*), a surface region of a sintered magnet body 30, having a thickness of 1 mm, is divided into a first layer portion 30*a* with a thickness of 500 μm as measured from the surface and a second layer portion 30*b* that also has a thickness of 500 μm and that is located deeper inside the sintered magnet body 30 than the first layer portion 30*a*. Then, the difference $\Delta H_{cJ}2$ in coercivity between the first and second layer portions 30*a* and 30*b* becomes 300 kA/m or less.

According to any of the conventional techniques disclosed in Patent Documents Nos. 1 through 6, the surface of the sintered magnet body is covered with a coating of a rare-earth metal, which is then diffused inside the magnet by heat treatment. That is why compared to the evaporation diffusion process of the present invention, the intragrain diffusion would have advanced more significantly and reached the core of the main phase crystal grains even deeper inside the magnet. For that reason, in the surface portion of the sintered magnet bodies disclosed in those documents, the RH diffused layer would have a thickness of well over 2 μm due to the intragrain diffusion of the heavy rare-earth element RH.

According to these conventional methods in which the surface of a sintered magnet body is covered with a coating of a rare-earth metal that is then diffused inside the magnet by heat treatment, the depth that the heavy rare-earth element RH can reach is shallower than the one realized by the evaporation diffusion process, and is usually as a matter of several ten μm in their working examples. That is why if the surface portion were removed from any of those sintered magnet bodies, the heavy rare-earth element RH that has been introduced intentionally by the heat treatment would be lost almost entirely, and therefore, the coercivity could be increased effectively. According to the evaporation diffusion process, on the other hand, the heavy rare-earth element RH can be introduced deeper into the magnet body (to a depth of several hundred μm to 1,000 μm or more) with the intragrain diffusion minimized. For that reason, even if the surface portion was removed from the magnet body, the coercivity should hardly decrease compared to the magnet body that still has the surface portion.

Hereinafter, it will be described exactly how deep the surface portion needs to be removed. It should be noted that the "amount of the surface portion removed" herein means the thickness of the surface portion removed and corresponds to the depth as measured from the surface of the sintered magnet body that still has that surface portion.

The surface portion is preferably removed to such a depth that the peaks of the diffused layer often agree with the baseline in FIGS. 3 and 4, i.e., until a region where the heavy rare-earth element RH rarely reaches the core of the main phase crystal grains gets exposed. Specifically, in the magnet shown in FIG. 3, the surface portion is preferably removed to a depth of approximately 100 μm as measured from the surface. On the other hand, in the magnet shown in FIG. 4, the surface portion is preferably removed to a depth of approximately 20 μm as measured from the surface.

The amount of the heavy rare-earth element RH diffused and its diffusion rate will depend on the diffusion conditions and the distribution of the RH concentration in the original magnet. That is why the preferred thickness of the surface portion to remove will vary according to those parameters. In any case, the thickness of the surface portion to remove is preferably determined so that the RH diffused layer that the crystal grains of the $R_2Fe_{14}B$ type compound will have at a depth of 20 μm under the surface of the sintered magnet body when the surface portion is removed, i.e., the $(RL_{1-x}RH_x)_2Fe_{14}B$ (where $0.2 \leq x \leq 0.75$) layer, will have an average thickness of 2 μm or less.

As used herein, the average thickness of the $(RL_{1-x}RH_x)_2Fe_{14}B$ (where $0.2 \leq x \leq 0.75$) layer at a depth of 20 μm under the surface is supposed to be the average of the thicknesses of the $(RL_{1-x}RH_x)_2Fe_{14}B$ (where $0.2 \leq x \leq 0.75$) layer that have been measured at ten or more arbitrary main phase crystal grains at a depth of 20 μm under the surface.

If the average thickness of the RH diffused layer in the outer periphery of main phase crystal grains exceeded 2 μm, then only a minority of those main phases would be still free from the heavy rare-earth element RH diffused and the remanence could not be recovered effectively. However, if the RH diffused layer has a thickness of 2 μm or less, then those main phase crystal grains that are still free from the heavy rare-earth element RH diffused will have a thickness of at least 1 μm, for example. Thus, the RH diffused layer preferably has a thickness of 1 μm or less, more preferably 0.5 μm or less. It should be noted that the thickness of the diffused layer could be measured on a cross section of the magnet body in the depth direction, for example. But if the RH diffused layer were too thin to get measured with an EPMA (e.g., if the RH diffused layer had a thickness of 0.5 μm or less), then its thickness could be measured with a TEM. Using a TEM, such a thin RH diffused layer can also be detected as long as its thickness is at least about 10 nm. That is why the lower limit of the thickness of the RH diffused layer detectable will be 10 nm. However, even such a thin RH diffused layer could still increase the coercivity sufficiently. Consequently, as will be described later about experimental examples, where the coercivity has increased compared to the sintered magnet yet to be subjected to the diffusion process, there will be such a very thin RH diffused layer in the outer periphery of main phase crystal grains.

The surface portion is more preferably removed to such a depth that the peaks of the RH diffused layer shown in FIGS. 3 and 4 are so low as the baseline that the Dy introduced by diffusion process is no longer detectable, i.e., a region in an ideal state where the heavy rare-earth element RH is distributed very thinly through diffusion in the outer periphery of the main phase crystal grains. In that case, the RH diffused layer has a thickness of 0.5 μm or less.

If the thickness of the surface portion removed is in the range of 5 μm to 500 μm, the remanence $B_r$ can be recovered almost without decreasing the coercivity $H_{cJ}$. The thickness of the surface portion removed is preferably 20 μm through 300 μm, more preferably from 50 μm through 200 μm.

Hereinafter, it will be described in further detail, based on specific experimental data, how deep the surface portion needs to be removed and how much the coercivity will change with the removal of that surface portion, while also taking a difference from the prior art into consideration.

The following Table 2 summarizes how the thickness of the Dy diffused layer changed with that of the surface portion removed from various sintered magnet bodies in which Dy had been diffused by mutually different methods. Specifically, as the methods for diffusing Dy, adopted were the evaporation diffusion process for use in the present invention and the conventional diffusion process (i.e., a heat treatment was carried out after a Dy film had been deposited).

Samples prepared by the evaporation diffusion process were obtained by the same method as the one to make Sample A1 of EXAMPLE 1 to be described later. Thereafter, the surface portions of each of those sample sintered magnet bodies (which had dimensions of 7 mm square on both sides) were removed by grinding using a surface grinder to the depth shown in Table 2. Then, the thickness of the Dy diffused layer (as the average of thicknesses that had been measured at 10 points) at a depth of 20 μm under each of the two surfaces of the ground magnet body was estimated with a TEM.

Meanwhile, samples were also obtained by the conventional Dy diffusion process. Specifically, a Dy film was deposited to mutually different thicknesses on the surface of sintered magnet bodies by sputtering process and then thermally treated at 900° C. for 120 minutes. The Dy films thus deposited had thicknesses of 15 μm, 3 μm and 0.5 μm. As for the sintered magnet bodies on which Dy had been diffused in this manner, the surface portion was also removed from the magnets by grinding and then the thickness of the Dy diffused layer was also measured just as described above.

TABLE 2

| | Thickness of Dy diffused layer (μm) | | | |
|---|---|---|---|---|
| Thickness reduced (μm) | Evaporation diffusion | Dy deposited to 15 μm and then heat-treated | Dy deposited to 3 μm and then heat-treated | Dy deposited to 0.5 μm and then heat-treated |
| 0 | 1.8 | 2.5 | 2.2 | 1.5 |
| 2 | 1.8 | 2.5 | 2.2 | 1.5 |
| 5 | 1.5 | 2.2 | 2.0 | 1.0 |
| 50 | 1.3 | 2.2 | 1.0 | NA |
| 100 | 1.0 | 2.2 | 0.5 | NA |
| 200 | 0.5 | 2.1 | 0.1 or less | NA |
| 500 | 0.3 | 1.8 | NA | NA |
| 1000 | 0.1 or less | 0.5 | NA | NA |

As for each of these samples, its magnetic properties (i.e., the remanence $B_r$ and the coercivity $H_{cJ}$ in this case) were measured with a B—H tracer before and after the surface portion was removed from the sintered magnet body. The following Table 3 summarizes how the magnetic properties changed with the thickness of the surface portion removed:

TABLE 3

| | $B_r$ [T] | | | | $H_{cJ}$ (kA/m) | | | |
|---|---|---|---|---|---|---|---|---|
| Thickness reduced (μm) | Evaporation diffusion | Dy deposited to 15 μm and heat-treated | Dy deposited to 3 μm and heat-treated | Dy deposited to 0.5 μm and heat-treated | Evaporation diffusion | Dy deposited to 15 μm and heat-treated | Dy deposited to 3 μm and heat-treated | Dy deposited to 0.5 μm and heat-treated |
| 0 | 1.38 | 1.36 | 1.37 | 1.39 | 1280 | 1250 | 1090 | 1010 |
| 2 | 1.38 | 1.36 | 1.37 | 1.39 | 1275 | 1245 | 1085 | 980 |
| 5 | 1.39 | 1.36 | 1.38 | 1.40 | 1275 | 1245 | 1080 | 950 |
| 50 | 1.39 | 1.36 | 1.40 | 1.40 | 1270 | 1240 | 1080 | 850 |
| 100 | 1.40 | 1.37 | 1.40 | 1.40 | 1270 | 1240 | 1020 | 850 |
| 200 | 1.40 | 1.37 | 1.40 | 1.40 | 1270 | 1230 | 900 | 850 |
| 500 | 1.40 | 1.38 | 1.40 | 1.40 | 1250 | 1180 | 850 | 850 |
| 1000 | 1.40 | 1.40 | 1.40 | 1.40 | 1185 | 1070 | 850 | 850 |

As can be seen from the results of measurements shown in Table 3, if the surface portion with a thickness of 5 μm to 500 μm was removed from the magnet body that had gone through the evaporation diffusion process, the remanence $B_r$ could be recovered with the coercivity $H_{cJ}$ still increased effectively. The present inventors also discovered that if the thickness of the surface portion removed was less than 5 μm, the remanence $B_r$ could not be recovered sufficiently effectively even with the removal of the surface portion but that if the thickness of the surface portion removed was greater than 500 μm, then the effect of increasing the coercivity $H_{cJ}$ by the RH diffusion process was lessened. We also confirmed, by carrying out a point analysis using a TEM as in the specific examples of the present invention to be described later, that the diffused layer located at a depth of 20 μm under the surface of the magnet body, from which the surface portion had been removed by 5 μm, had a uniform composition in which x (=0.37) had a dispersion of 10% or less.

When a magnet according to the present invention, obtained by removing a surface portion to a depth of 5 μm from a magnet body that had gone through the evaporation diffusion process, had its surface portion further removed by 200 μm from the (machined) surface that had been exposed as a result of the former surface portion removal process, the resultant magnet (that had had its surface portion removed by 205 μm in total each side) had almost as high coercivity as the magnet body that had had its surface portion removed by 200 μm as shown in Table 3. And the difference $\Delta H_{cJ}1$ in coercivity from the magnet body that had had its surface portion removed by 5 μm was 5 kA/m. According to the evaporation diffusion process, $\Delta H_{cJ}1$ can be reduced to 150 kA/m or less, more favorably 100 kA/m or less.

Meanwhile, according to the method in which a Dy film is deposited on the surface of a magnet body and then Dy is diffused through heat treatment, if a relatively thick Dy film (which had a thickness of 15 μm in the experimental example described above) was deposited and if an increased amount of Dy was diffused, then the Dy diffused layer in the main phase crystal grains in the surface region of the magnet body would have a thickness of more than 2.0 μm. That is why to recover $B_r$ by setting the thickness of the Dy diffused layer to be 2.0 μm or less, the surface portion of the magnet body should be removed to a depth of 500 μm or more.

On the other hand, by reducing the thickness of the Dy film deposited (which had a thickness of 3 μm in the experimental example described above) and the amount of Dy diffused, $B_r$ can be recovered with the effect of increasing coercivity maintained, even if the thickness of the surface portion removed is within 5 μm. In that case, however, Dy diffused cannot reach deep inside the magnet. That is why if the surface portion of the magnet body were removed to a depth of 500 μm or more, the effect of increasing the coercivity would be lost altogether. Then, the difference $\Delta H_{cJ}1$ in coercivity between a magnet body which has gone through the diffusion process but from which no surface portion has been removed yet and a magnet body from which surface portions have been removed by 200 μm on both of the upper and lower surfaces would be as big as 190 kA/m (see FIG. 6(*a*)).

Furthermore, if the Dy film were deposited to a reduced thickness (which was 0.5 μm in the experimental example described above) and if a decreased amount of Dy was diffused, the effect of increasing the coercivity of the overall magnet body would be very little and Dy diffused would go no farther than the superficial region of the magnet body. In that case, if the surface portion were removed by as much as 50 μm, then the effect of increasing the coercivity would be lost completely. Then, even with a TEM, the thickness of the Dy diffused layer could not be detected (i.e., there would be no diffused layer detectable).

It should be noted that the evaluation method using $\Delta H_{cJ}1$ can be used effectively in a situation where the magnet body has a thickness of 1 mm to 4 mm.

If the thickness of the magnet body exceeds 2 mm (and preferably reaches more than 4 mm), then not just the evaluation using $\Delta H_{cJ}1$ described above but also the following evaluation method can be adopted as well.

Specifically, the surface region with a thickness of 1 mm as measured from the surface of a sintered magnet body was divided into a first layer portion that had a thickness of 500 μm as measured from the surface and a second layer portion that also had a thickness of 500 μm and that was located deeper inside the sintered magnet body than the first layer portion, and the difference $\Delta H_{cJ}2$ in coercivity between the first and second layer portions was measured (see FIG. 6(*b*)). The results of the measurements are shown in the following Table 4:

TABLE 4

| | Evaporation diffusion | | Deposited to 15 μm and then heat-treated | | Deposited to 3 μm and then heat-treated | | Deposited to 0.5 μm and then heat-treated | |
|---|---|---|---|---|---|---|---|---|
| | $H_{cJ}$ | $\Delta H_{cJ}2$ | $H_{cJ}$ | $\Delta H_{cJ}2$ | $H_{cJ}$ | $\Delta H_{cJ}2$ | $H_{cJ}$ | $\Delta H_{cJ}2$ |
| Shallower 500 μm of magnet body | 1360 | 65 | 1390 | 100 | 1360 | 510 | 1330 | 480 |
| Deeper 500 μm of magnet body | 1295 | | 1290 | | 850 | | 850 | |

As can be seen from the results shown in this Table 4, in the magnet body obtained by the evaporation diffusion process and in the magnet body in which a thicker Dy film (which was 15 μm in the experimental example described above) was deposited to increase the amount of Dy diffused, the Dy diffused reached deep inside the magnet body, and therefore, their $\Delta H_{cJ}2$ were 65 kA/m and 100 kA/m, respectively. In those magnet bodies, there was not so much difference in coercivity between the shallower 500 μm portion and the deeper 500 μm portion thereof (but in the magnet body in which a Dy film was deposited to a thickness of 15 μm and then heat-treated as in the experimental example described above, the surface region had a thick diffused layer and $B_r$ decreased significantly). However, in magnet bodies in which a thinner Dy film was deposited (to 3 μm and 0.5 μm, respectively, in the experimental example described above) and in which a decreased amount of Dy was diffused, Dy could go no farther than a depth of around 200 μm in the surface region. Consequently, their $\Delta H_{cJ}2$ were 510 kA/m and 480 kA/m, respectively, and therefore, there was a huge difference in coercivity between the shallower 500 μm portion and the deeper 500 μm portion. According to the evaporation diffusion process, $\Delta H_{cJ}2$ can be reduced to 300 kA/m or less, more favorably 200 kA/m or less.

As described above, according to the evaporation diffusion process, the intragrain diffusion will hardly occur in the surface region of the sintered magnet body, and the heavy rare-earth element RH diffused can reach deeper inside the magnet compared to the conventional method. That is why even if the surface portion of the magnet body was removed, the effect of increasing the coercivity would never be lessened and only the remanence $B_r$ could be recovered. On top of that, the diffusion process can be carried out with little heavy rare-earth element RH deposited on the wall surfaces of the evaporation system. On the other hand, according to the conventional method in which a coating of a heavy rare-earth element RH is deposited on the surface of a sintered magnet body and then the heavy rare-earth element RH is diffused inside the magnet body by heat treatment, to diffuse RH deep inside the magnet body, a thick RH film should be deposited. In that case, however, the intragrain diffusion would occur significantly even deep inside the magnet body. Also, to reduce the thickness of the diffused layer to 2 μm or less, the surface portion should be removed by as much as several hundred μm. Nevertheless, to avoid the intragrain diffusion, the thickness of the RH film should be reduced but the Dy diffused would remain in the surface region in that case. That is why if the surface portion were removed, the effect of increasing the coercivity should be lost. What is worse, the heavy rare-earth element RH would be inevitably deposited a lot on the wall surfaces of the deposition system, and the yield of RH would also decrease significantly.

Hereinafter, the evaporation diffusion process will be described in detail.

In the evaporation diffusion process, a bulk body of a heavy rare-earth element RH that is not easily vaporizable (or sublimable) and a rare-earth sintered magnet body are arranged close to each other in the processing chamber and both heated to a temperature of 700° C. to 1,000° C., thereby reducing the vaporization (or sublimation) of the RH bulk body to the point that the growth rate of an RH film is not excessively higher than the rate of diffusion of RH into the magnet and diffusing the heavy rare-earth element RH, which has traveled to reach the surface of the sintered magnet body, into the magnet body quickly. At such a temperature falling within the range of 700° C. to 1,000° C., the heavy rare-earth element RH hardly vaporizes (or sublimes) but diffuses actively in an R—Fe—B based rare-earth sintered magnet. For that reason, the grain boundary diffusion of the heavy rare-earth element RH into the magnet body can be accelerated more sharply than the film formation of the heavy rare-earth element RH on the surface of the magnet body.

According to the evaporation diffusion process, the heavy rare-earth element RH will diffuse and penetrate into the magnet at a higher rate than the heavy rare-earth element RH diffusing into the main phases that are located near the surface of the sintered magnet body.

In the prior art, it has been believed that to vaporize (or sublime) a heavy rare-earth element RH such as Dy, the magnet body should be heated to a temperature exceeding 1,000° C. and that it would be impossible to deposit Dy on the magnet body just by heating it to a temperature as low as 700° C. to 1,000° C. Contrary to this popular belief, however, the results of experiments the present inventors carried out revealed that the heavy rare-earth element RH could still be supplied onto an opposing rare-earth magnet and diffused into it even at such a low temperature of 700° C. to 1,000° C.

As disclosed in Patent Documents Nos. 1 through 6, according to the conventional technique of forming a film of a heavy rare-earth element RH (which will be referred to herein as an "RH film") on the surface of a sintered magnet body and then diffusing the element into the sintered magnet body by heat treatment process, so-called "intragrain diffusion" will advance significantly in the surface region of the magnet body that is in contact with the RH film, thus decreasing the remanence of the magnet. On the other hand, according to the evaporation diffusion process, since the heavy rare-earth element RH is supplied onto the surface of the sintered magnet body with the growth rate of the RH film decreased and the temperature of the sintered magnet body is maintained at an appropriate level for diffusion, the heavy rare-earth element RH that has reached the surface of the magnet body quickly penetrates into the sintered magnet body by grain boundary diffusion. That is why even in the surface region of the magnet body, the "grain boundary diffusion" advances more preferentially than the "intragrain diffusion". As a result, the decrease in remanence $B_r$ can be minimized and the coercivity $H_{cJ}$ can be increased effectively.

The R—Fe—B based rare-earth sintered magnet has a nucleation type coercivity generating mechanism. Therefore, if the magnetocrystalline anisotropy is increased in the outer periphery of a main phase, the nucleation of reverse magnetic domains can be reduced in the vicinity of the grain boundary phase surrounding the main phase. As a result, the coercivity $H_{cJ}$ of the main phase can be increased effectively as a whole. According to the evaporation diffusion process, the heavy rare-earth replacement layer can be formed in the outer periphery of the main phase not only in a surface region of the sintered magnet body but also deep inside the magnet. Consequently, the magnetocrystalline anisotropy can be increased in the entire magnet and the coercivity $H_{cJ}$ of the overall magnet increases sufficiently. Therefore, the magnet, into which RH has been introduced by evaporation diffusion and from which the surface portion of the sintered magnet body has been removed after that, can have an increased coercivity $H_{cJ}$ almost without decreasing its remanence $B_r$.

Considering the facility of evaporation diffusion, the cost and other factors, it is most preferable to use Dy as the heavy rare-earth element RH that replaces the light rare-earth element RL in the outer periphery of the main phase. However, the magnetocrystalline anisotropy of $Tb_2Fe_{14}B$ is higher than that of $Dy_2Fe_{14}B$ and is about three times as high as that of $Nd_2Fe_{14}B$. That is why if Tb is evaporated and diffused, the coercivity can be increased most efficiently without decreasing the remanence of the sintered magnet body. When Tb is used, the evaporation diffusion is preferably carried out at a higher temperature and in a higher vacuum than a situation where Dy is used.

As can be seen easily from the foregoing description, according to the present invention, the heavy rare-earth element RH does not always have to be added to the material alloy. That is to say, a known R—Fe—B based rare-earth sintered magnet, including a light rare-earth element RL (which is at least one of Nd and Pr) as the rare-earth element R, may be provided and then the heavy rare-earth element RH may be diffused inward from the surface of the magnet. If only the conventional heavy rare-earth film were formed on the surface of the magnet, it would be difficult to diffuse the heavy rare-earth element RH deep inside the magnet even at an elevated diffusion temperature. However, according to the present invention, by producing the grain boundary diffusion of the heavy rare-earth element RH, the heavy rare-earth element RH can be supplied efficiently to even the outer periphery of the main phases that are located deep inside the sintered magnet body. The present invention is naturally applicable to an R—Fe—B based sintered magnet, to which the heavy rare-earth element RH was already added when it was a material alloy. However, if a lot of heavy rare-earth element RH were added to the material alloy, the effect of the present invention would not be achieved sufficiently. For that reason, a relatively small amount of heavy rare-earth element RH may be added in that early stage.

Next, an example of a preferred evaporation diffusion process will be described with reference to FIG. 7, which illustrates an exemplary arrangement of sintered magnet bodies 2 and RH bulk bodies 4. In the example illustrated in FIG. 7, the sintered magnet bodies 2 and the RH bulk bodies 4 are arranged so as to face each other with a predetermined gap left between them inside a processing chamber 6 made of a refractory metal. The processing chamber 6 shown in FIG. 7 includes a member for holding a plurality of sintered magnet bodies 2 and a member for holding the RH bulk body 4. Specifically, in the example shown in FIG. 7, the sintered magnet bodies 2 and the upper RH bulk body 4 are held on a net 8 made of Nb. However, the sintered magnet bodies 2 and the RH bulk bodies 4 do not have to be held in this way but may also be held using any other member. Nevertheless, a member that closes the gap between the sintered magnet bodies 2 and the RH bulk bodies 4 should not be used. As used herein, "facing" means that the sintered magnet bodies and the RH bulk bodies are opposed to each other without having their gap closed. Also, even if two members are arranged "so as to face each other", it does not necessarily mean that those two members are arranged such that their principal surfaces are parallel to each other.

By heating the processing chamber 6 with a heater (not shown), the temperature of the processing chamber 6 is raised. In this case, the temperature of the processing chamber 6 is controlled to the range of 700° C. to 1,000° C., more preferably to the range of 850° C. to 950° C. In such a temperature range, the heavy rare-earth element RH has a very low vapor pressure and hardly vaporizes. In the prior art, it has been commonly believed that in such a temperature range, a heavy rare-earth element RH, vaporized from an RH bulk body 4, be unable to be supplied and deposited on the surface of the sintered magnet body 2.

However, the present inventors discovered that by arranging the sintered magnet body 2 and the RH bulk body 4 close to each other, not in contact with each other, a heavy rare-earth metal could be supplied at as low a rate as several Jim per hour (e.g., in the range of 0.5 μm/hr to 5 μm/hr) on the surface of the sintered magnet body 2. We also discovered that by controlling the temperature of the sintered magnet body 2 within an appropriate range such that the temperature of the sintered magnet body 2 was equal to or higher than that of the RH bulk body 4, the heavy rare-earth metal RH that had been supplied in vapor phase could be diffused deep into the sintered magnet body 2 as it was. This temperature range is a preferred one in which the RH metal diffuses inward through the grain boundary phase of the sintered magnet body 2. As a result, slow supply of the RH metal and quick diffusion thereof into the magnet body can be done efficiently.

According to the evaporation diffusion process, RH that has vaporized just slightly as described above is supplied at a low rate on the surface of the sintered magnet body. For that reason, there is no need to heat the processing chamber to a high temperature that exceeds 1,000° C. or apply a voltage to the sintered magnet body or RH bulk body as in the conventional process of depositing RH by vapor phase deposition.

Also, according to the evaporation diffusion process, with the vaporization and sublimation of the RH bulk body minimized, the heavy rare-earth element RH that has arrived at the surface of the sintered magnet body is quickly diffused inside the magnet body. For that purpose, the RH bulk body and the sintered magnet body preferably both have a temperature falling within the range of 700° C. to 1,000° C.

The gap between the sintered magnet body 2 and the RH bulk body 4 is preferably set to fall within the range of 0.1 mm to 300 mm. This gap is more preferably 1 mm to 50 mm, even more preferably 20 mm or less, and most preferably 10 mm or less. As long as such a distance can be kept between them, the sintered magnet bodies 2 and the RH bulk bodies 4 may be arranged either vertically or horizontally or may even be moved relative to each other. Nevertheless, the distance between the sintered magnet bodies 2 and the RH bulk bodies 4 preferably remains the same during the evaporation diffusion process. Also, an embodiment in which the sintered magnet bodies are contained in a rotating barrel and processed while be stirred up is not preferred. Furthermore, since the vaporized RH can create a uniform RH atmosphere within the distance range defined above, the area of their opposing surfaces is not particularly limited but even their narrowest surfaces may face each other.

The present inventors discovered and confirmed via experiments that when the RH bulk bodies were arranged perpendicularly to the magnetization direction (i.e., the c-axis direction) of the sintered magnet bodies 2, RH could diffuse into the sintered magnet bodies 2 most efficiently. This is probably because when RH diffuses inward through the grain boundary phase of the sintered magnet bodies 2, the diffusion rate in the magnetization direction is higher than the rate in the perpendicular direction. That difference in diffusion rate between the magnetization and perpendicular directions should be caused by a difference in anisotropy due to the crystal structure.

In a conventional evaporation system, a good distance should be kept between an evaporating material supply section and the target being processed because a mechanism surrounding the evaporating material supply section or the target holding member such as a barrel would make interference and the evaporating material supply section should be exposed to an electron beam or an ion beam. For that reason, the evaporating material supply section (corresponding to the RH bulk body 4) and the target being processed (corresponding to the sintered magnet body 2) have never been arranged so close to each other as in the evaporation diffusion process. As a result, it has been believed that unless the evaporating material is heated to a rather high temperature and vaporized sufficiently, plenty of the evaporating material could not be supplied onto the target being processed.

In contrast, according to the evaporation diffusion process, the RH metal can be supplied onto the surface of the magnet just by controlling the temperature of the overall processing chamber without using any special mechanism for vaporizing (or subliming) the evaporating material. As used herein, the "processing chamber" broadly refers to a space in which the sintered magnet bodies 2 and the RH bulk bodies 4 are arranged. Thus, the processing chamber may mean the processing chamber of a heat treatment furnace but may also mean a process vessel housed in such a processing chamber.

Also, according to the evaporation diffusion process, the RH metal vaporizes little but the sintered magnet body and the RH bulk body are arranged close to each other but not in contact with each other. That is why the RH metal vaporized can be supplied onto the surface of the sintered magnet body efficiently and is hardly deposited on the wall surfaces of the processing chamber. Furthermore, if the wall surfaces of the processing chamber are made of a heat-resistant alloy including Nb, for example, a ceramic, or any other material that does not react to RH, then the RH metal deposited on the wall surfaces will vaporize again and will reach the surface of the sintered magnet body after all. As a result, it is possible to avoid an unwanted situation where the heavy rare-earth element RH, which is one of valuable rare natural resources, is wasted in vain.

Within the processing temperature range of the diffusion process to be carried out as an evaporation diffusion process, the RH bulk body never melts or softens but the RH metal vaporizes (sublimes) from its surface. For that reason, the RH bulk body does not change its appearance significantly after having gone through the process step just once, and therefore, can be used repeatedly a number of times.

Besides, as the RH bulk bodies and the sintered magnet bodies are arranged close to each other, the number of sintered magnet bodies that can be loaded into a processing chamber with the same capacity can be increased. That is to say, high loadability is realized. In addition, since no bulky system is required, a normal vacuum heat treatment furnace may be used and the increase in manufacturing cost can be avoided, which is very beneficial in practical use.

During the heat treatment process, an inert atmosphere is preferably maintained inside the processing chamber. As used herein, the "inert atmosphere" refers to a vacuum or an atmosphere filled with an inert gas. Also, the "inert gas" may be a rare gas such as argon (Ar) gas but may also be any other gas as long as the gas is not chemically reactive between the RH bulk body and the sintered magnet body. The pressure of the inert gas is reduced so as to be lower than the atmospheric pressure. If the pressure of the atmosphere inside the processing chamber were close to the atmospheric pressure, then the RH metal could not be supplied easily from the RH bulk body to the surface of the sintered magnet body. However, since the amount of the RH metal diffused is determined by the rate of diffusion from the surface of the magnet toward the inner portion thereof, it should be enough to lower the pressure of the atmosphere inside the processing chamber to $10^2$ Pa or less, for example. That is to say, even if the pressure of the atmosphere inside the processing chamber were further lowered, the amount of the RH metal diffused (and eventually the degree of increase in coercivity) would not change significantly. The amount of the RH metal diffused is more sensitive to the temperature of the sintered magnet body, rather than the pressure.

The RH metal that has traveled to reach the surface of the sintered magnet body starts to diffuse toward the inner portion of the magnet through the grain boundary phase under the driving forces generated by the heat of the atmosphere and the difference in RH concentration at the interface of the magnet. In the meantime, a portion of the light rare-earth element RL in the $R_2Fe_{14}B$ phase is replaced with the heavy rare-earth element RH that has diffused and penetrated through the surface of the magnet. As a result, a layer including the heavy rare-earth element RH at a high concentration is formed in the outer periphery of the $R_2Fe_{14}B$ phase.

By forming such an RH diffused layer (or a layer including the RH at a higher concentration, which will be referred to herein as an "RH concentrated layer"), the magnetocrystalline anisotropy can be improved in the outer periphery of the main phase grain and the coercivity $H_{cJ}$ can be increased. That is to say, even by using a small amount of RH metal, the heavy rare-earth element RH can diffuse and penetrate deeper into the magnet and the RH diffused layer can be formed in the outer periphery of the main phase efficiently. As a result, the coercivity $H_{cJ}$ of the overall magnet can be increased with the decrease in remanence $B_r$ minimized.

According to the conventional method by which a film of a heavy rare-earth element RH (which will be referred to herein as an "RH film") is deposited on the surface of a sintered magnet body and then thermally treated to diffuse inside the sintered magnet body as disclosed in Patent Documents Nos. 1 through 6, the rate of deposition of the heavy rare-earth element RH such as Dy on the surface of the sintered magnet body (i.e., a film growth rate) is much higher than the rate of diffusion of the heavy rare-earth element RH toward the inner portion of the sintered magnet body (i.e., a diffusion rate). That is why an RH film is deposited to a thickness of several μm or more on the surface of the sintered magnet body and then the heavy rare-earth element RH is diffused from that RH film in solid phase toward the inner portion of the sintered magnet body. However, the heavy rare-earth element RH that has been supplied from the RH film in solid phase, not in vapor phase, will diffuse under the driving force generated by a steep concentration gradient at the interface between the magnet body and the RH film. Thus, the heavy rare-earth element RH not only diffuses through the grain boundary but also makes an intragrain diffusion inside the main phase that is located in the surface region of the magnet body, thus causing a significant decrease in remanence $B_r$. That region in which the heavy rare-earth element RH makes such an intragrain diffusion inside the main phase to decrease the remanence is limited to the surface region of the sintered magnet body (with a thickness of 100 μm to several hundred μm, for example). Therefore, at least that portion should be removed.

On the other hand, according to the evaporation diffusion process, the heavy rare-earth element RH such as Dy that has vaporized (or sublimed) from the RH bulk bodies would impinge on the surface of the sintered magnet body and then quickly diffuse toward the inner portion of the sintered magnet body directly in vapor phase, without passing through the RH film in solid phase. That is why RH would diffuse inside the magnet not because of the driving force generated by the steep concentration gradient at the interface between the magnet body and the RH film as in the method in which an RH film is deposited and then thermally treated, but based on another principle such as chemical affinity. As the evaporation diffusion process is ruled by such a principle, the heavy rare-earth element RH will diffuse through the grain boundary phase at a higher rate and penetrate deeper into the sintered magnet body before diffusing and reaching the core of the main phase that is located in the surface region of the magnet body. As a result, a unique structure that cannot be obtained by any method other than the evaporation diffusion process disclosed herein can be obtained, thus improving the performance of the magnet by leaps and bounds. That is to say, the evaporation diffusion process is advantageous in that the intragrain diffusion will not occur easily even in the surface region of the magnet body and that the portion to remove may have just a small thickness. On top of that, since RH will diffuse and penetrate deep inside the sintered magnet body, plenty of RH, of which the concentration is high enough to increase the coercivity sufficiently, will still be left inside the magnet even if the surface portion of the magnet is removed. Consequently, the remanence can also be recovered without lessening the effect of increasing the coercivity.

The concentration of the RH to diffuse and introduce is preferably within the range of 0.05 wt % to 1.5 wt % of the overall magnet. This concentration range is preferred because at an RH concentration of more than 1.5 wt %, the intragrain diffusion would occur so much even in the crystal grains in the sintered magnet body that the decrease in remanence $B_r$ could be out of control even if the surface portion were removed but because the increase in coercivity $H_{cJ}$ would be insufficient at an RH concentration of less than 0.05 wt %. By conducting a heat treatment process for 10 to 180 minutes within the temperature range and the pressure range defined above, an amount of diffusion of 0.1 wt % to 1 wt % is realized. The process time means a period of time in which the RH bulk body and the sintered magnet body have temperatures of 700° C. to 1,000° C. and pressures of $10^{-5}$ Pa to 500 Pa. Thus, during this process time, their temperatures and pressures are not always kept constant.

The surface state of the sintered magnet, into which RH has not been diffused or introduced yet, is preferably as close to a metal state as possible to allow the RH to diffuse and penetrate easily. For that purpose, the sintered magnet is preferably subjected to an activation treatment such as acid cleaning or blast cleaning in advance. According to the evaporation diffusion process, however, when the heavy rare-earth element RH vaporizes and gets supplied in an active state onto the surface of the sintered magnet body, the heavy rare-earth element RH will diffuse toward the inner portion of the sintered magnet body at a higher rate than the rate of forming a solid layer. That is why the surface of the sintered magnet body may also have been oxidized to a certain degree as is observed right after a sintering process or a cutting process. Since an R—Fe—B based sintered magnet exhibits some anisotropy while shrinking during sintering, the magnet is normally subjected to a size adjustment after the sintering process. On the other hand, according to a process other than the evaporation diffusion process, the surface of the sintered magnet body, on which an RH film has not been deposited yet, should be polished to remove a surface oxide layer from it. For that reason, the size adjustment is usually done before the RH film is deposited. According to the evaporation diffusion process, however, the size adjustment can also be done on an as-sintered magnet, of which the surface has been rather oxidized. Consequently, the size adjustment and the removal of the surface portion from the magnet body can be done at the same time, which is advantageous.

According to the evaporation diffusion process, the heavy rare-earth element RH can be diffused mainly through the grain boundary phase. For that reason, the heavy rare-earth element RH can be diffused deeper into the magnet more efficiently by controlling the process time.

The shape and size of the RH bulk bodies are not particularly limited. For example, the RH bulk bodies may have a plate shape or an indefinite shape (e.g., a stone shape). Optionally, the RH bulk bodies may have a lot of very small holes with diameters of several ten μm. The RH bulk bodies are preferably made of either an RH metal including at least one heavy rare-earth element RH or an alloy including RH. Also, the higher the vapor pressure of the material of the RH bulk bodies, the greater the amount of RH that can be introduced per unit time, and the more efficient. Oxides, fluorides and nitrides including a heavy rare-earth element RH have so low vapor pressures that evaporation diffusion hardly occurs under the conditions falling within these ranges of temperatures and degrees of vacuum. For that reason, even if the RH bulk bodies are made of an oxide, a fluoride or a nitride including the heavy rare-earth element RH, the coercivity cannot be increased effectively.

Hereinafter, preferred embodiments of a method for producing an R—Fe—B based rare-earth sintered magnet according to the present invention will be described.

EMBODIMENTS

Material Alloy

First, an alloy including 25 mass % to 40 mass % of a light rare-earth element RL, 0.6 mass % to 1.6 mass % of B (boron) and Fe and inevitably contained impurities as the balance is provided. A portion of B may be replaced with C (carbon) and a portion (at most 50 at %) of Fe may be replaced with another transition metal element such as Co or Ni. For various purposes, this alloy may contain about 0.01 mass % to about 1.0 mass % of at least one additive element M that is selected from the group consisting of Al, Si, Ti, V, Cr, Mn, Ni, Cu, Zn, Ga, Zr, Nb, Mo, Ag, In, Sn, Hf, Ta, W, Pb and Bi.

Such an alloy is preferably made by quenching a melt of a material alloy by strip casting, for example. Hereinafter, a method of making a rapidly solidified alloy by strip casting will be described.

First, a material alloy with the composition described above is melted by induction heating within an argon atmosphere to make a melt of the material alloy. Next, this melt is kept heated at about 1,350° C. and then quenched by single roller process, thereby obtaining a flake-like alloy block with a thickness of about 0.3 mm. Then, the alloy block thus obtained is pulverized into flakes with a size of 1 mm to 10 mm before being subjected to the next hydrogen pulverization process. Such a method of making a material alloy by strip casting is disclosed in U.S. Pat. No. 5,383,978, for example.

Coarse Pulverization Process

Next, the material alloy block that has been coarsely pulverized into flakes is loaded into a hydrogen furnace and then subjected to a hydrogen decrepitation process (which will be sometimes referred to herein as a "hydrogen pulverization process") within the hydrogen furnace. When the hydrogen pulverization process is over, the coarsely pulverized alloy powder is preferably unloaded from the hydrogen furnace in an inert atmosphere so as not to be exposed to the air. This should prevent the coarsely pulverized powder from being oxidized or generating heat and would eventually improve the magnetic properties of the resultant magnet.

As a result of this hydrogen pulverization process, the rare-earth alloy is pulverized to sizes of about 0.1 mm to several millimeters with a mean particle size of 500 μm or less. After the hydrogen pulverization, the decrepitated material alloy is preferably further crushed to finer sizes and cooled. If the material alloy unloaded still has a relatively high temperature, then the alloy should be cooled for a longer time.

Fine Pulverization Process

Next, the coarsely pulverized powder is finely pulverized with a jet mill pulverizing machine. A cyclone classifier is connected to the jet mill pulverizing machine for use in this preferred embodiment. The jet mill pulverizing machine is fed with the rare-earth alloy that has been coarsely pulverized in the coarse pulverization process (i.e., the coarsely pulverized powder) and gets the powder further pulverized by its pulverizer. The powder, which has been pulverized by the pulverizer, is then collected in a collecting tank by way of the cyclone classifier. In this manner, a finely pulverized powder with sizes of about 0.1 μm to about 20 μm (typically 3 μm to 5 μm) can be obtained. The pulverizing machine for use in such a fine pulverization process does not have to be a jet mill but may also be an attritor or a ball mill. Optionally, a lubricant such as zinc stearate may be added as an aid for the pulverization process.

Press Compaction Process

In this preferred embodiment, 0.3 wt % of lubricant is added to, and mixed with, the magnetic powder, obtained by the method described above, in a rocking mixer, for example, thereby coating the surface of the alloy powder particles with the lubricant. Next, the magnetic powder prepared by the method described above is compacted under an aligning magnetic field using a known press machine. The aligning magnetic field to be applied may have a strength of 1.5 to 1.7 tesla (T), for example. Also, the compacting pressure is set such that the green compact has a green density of about 4 g/cm$^3$ to about 4.5 g/cm$^3$.

Sintering Process

The powder compact described above is preferably sequentially subjected to the process of maintaining the compact at a temperature of 650° C. to 1,000° C. for 10 to 240 minutes and then to the process of further sintering the compact at a higher temperature (of 1,000° C. to 1,200° C., for example) than in the maintaining process. Particularly when a liquid phase is produced during the sintering process (i.e., when the temperature is in the range of 650° C. to 1,000° C.), the R-rich phase on the grain boundary phase starts to melt to produce the liquid phase. Thereafter, the sintering process advances to form a sintered magnet body eventually. The sintered magnet body can also be subjected to the evaporation diffusion process even if its surface has been oxidized as described above. For that reason, the sintered magnet body may be subjected to an aging treatment (at a temperature of 400° C. to 700° C.) or machined to adjust its size.

Diffusion Process

Next, the heavy rare-earth element RH is made to diffuse and penetrate efficiently into the sintered magnet body thus obtained, thereby increasing its coercivity $H_{cJ}$. More specifically, an RH bulk body, including the heavy rare-earth element RH, and a sintered magnet body are put into the processing chamber shown in FIG. 7 and then heated, thereby diffusing the heavy rare-earth element RH into the sintered magnet body while supplying the heavy rare-earth element RH from the RH bulk body onto the surface of the sintered magnet body simultaneously.

In the diffusion process of this preferred embodiment, the temperature of the sintered magnet body is preferably set equal to or higher than that of the bulk body. As used herein, when the temperature of the sintered magnet body is equal to or higher than that of the bulk body, it means that the difference in temperature between the sintered magnet body and the bulk body is within 20° C. Specifically, the temperatures of the RH bulk body and the sintered magnet body preferably both fall within the range of 700° C. to 1,000° C. Also, the gap between the sintered magnet body and the RH bulk body should be within the range of 0.1 mm to 300 mm, preferably 3 mm to 100 mm, and more preferably 4 mm to 50 mm, as described above.

Also, the pressure of the atmospheric gas during the evaporation diffusion process preferably falls within the range of $10^{-5}$ Pa to 500 Pa. Then, the evaporation diffusion process can be carried out smoothly with the vaporization (sublimation) of the RH bulk body advanced appropriately. To carry out the evaporation diffusion process efficiently, the pressure of the atmospheric gas preferably falls within the range of $10^{-3}$ Pa to 1 Pa. Furthermore, the amount of time for maintaining the temperatures of the RH bulk body and the sintered magnet body within the range of 700° C. to 1,000° C. is preferably 10 to 600 minutes. It should be noted that the "time for maintaining the temperatures" refers to a period in which the RH bulk body and the sintered magnet body have temperatures varying within the range of 700° C. to 1,000° C. and pressures varying within the range of $10^{-5}$ Pa to 500 Pa and does not necessarily refer to a period in which the RH bulk body and sintered magnet body have their temperatures and pressures fixed at a particular temperature and a particular pressure.

The diffusion process of this preferred embodiment is not sensitive to the surface status of the sintered magnet body, and therefore, a film of Al, Zn or Sn may be deposited on the surface of the sintered magnet body before the diffusion process. This is because Al, Zn and Sn are low-melting metals and because a small amount of Al, Zn or Sn would not deteriorate the magnetic properties or would not interfere with the diffusion, either.

It should be noted that the bulk body does not have to be made of a single element but may include an alloy of a heavy rare-earth element RH and an element X, which is at least one element selected from the group consisting of Nd, Pr, La, Ce, Al, Zn, Sn, Cu, Co, Fe, Ag and In. Such an element X would lower the melting point of the grain boundary phase and would hopefully promote the grain boundary diffusion of the heavy rare-earth element RH. By thermally treating, in a vacuum, the bulk body of such an alloy and an Nd sintered magnet that are spaced from each other, the heavy rare-earth element RH and the element X can be not only evaporated and supplied onto the surface of the magnet but also diffused into the magnet through the grain boundary phase (Nd-rich phase) that has turned into a liquid phase preferentially.

Also, during the heat treatment for diffusion, very small amounts of Nd and Pr vaporize from the grain boundary phase. That is why the element X is preferably Nd and/or Pr because in that case, the element X would compensate for the Nd and/or Pr that has vaporized.

Optionally, after the diffusion process is over, an additional heat treatment process may be carried out. The additional heat treatment process may be carried out just by thermally treating the magnet with the partial pressure of Ar increased to about 500 Pa after the diffusion process such that the heavy rare-earth element RH will not vaporize. Alternatively, after the diffusion process has been finished once, only the heat treatment may be carried out without putting the RH bulk bodies. The processing temperature is preferably 700° C. to 1,000° C., more preferably 800° C. to 950° C. Even more preferably, the additional heat treatment temperature is equal to or lower than the processing temperature of the diffusion process.

This additional heat treatment process is particularly effective when carried out on a sintered magnet body with a thickness of 3 mm or more. This is because if the sintered magnet body is rather thick, then it is difficult to make the heavy rare-earth element RH diffuse and reach deep inside the magnet body and close to its core. That is why even if the coercivity of the sintered magnet body as a whole has increased, the coercivity $H_{cJ}$ could still have hardly increased at its core. As shown in FIG. 1, when the evaporation diffusion process is over, there will be some amount of heavy rare-earth element RH, which would not contribute to increasing the coercivity $H_{cJ}$, in the grain boundary phase near the surface of the sintered magnet body. Thus, by performing this additional heat treatment process, that heavy rare-earth element RH can be diffused even closer to the main phase deep inside the sintered magnet body. As a result, the coercivity $H_{cJ}$ will increase at the core of the magnet body, too.

For that reason, by performing the additional heat treatment process and the surface portion removing process in combination, even if the sintered magnet body is as thick as 3 mm or more, for example, a magnet, of which the remanence $B_r$ has hardly decreased and of which the coercivity $H_{cJ}$ has increased right to its core, can be provided. For instance, if the sintered magnet body has a thickness of 3 mm or more, then a difference $\Delta H_{cJ}3$ in coercivity between respective portions with a thickness of 1 mm that have the highest and the lowest coercivities in the thickness direction of the sintered magnet body will be within the range of 80 kA/m to 200 kA/m.

If necessary, an aging treatment is also carried out at a temperature of 400° C. to 700° C. If the additional heat treatment is carried out at a temperature of 700° C. to 1,000° C., the aging treatment is preferably performed after the additional heat treatment has ended. The additional heat treatment and the aging treatment may be conducted in the same processing chamber.

Surface Portion Removing Process

After the diffusion process, a surface portion is removed from the magnet body. A preferred thickness of the surface portion to remove will vary according to the diffusion process conditions as described above. However, by setting the thickness of the surface portion to remove within the range of 5 μm to 500 μm, the remanence $B_r$ can be recovered without decreasing the coercivity $H_{cJ}$, compared to the magnet body that has just gone through the diffusion process. This range is preferred for the following reasons. Specifically, if the thickness of the surface portion to remove were smaller than 5 μm, then a portion in which the intragrain diffusion of the heavy rare-earth element RH has occurred significantly would remain, and therefore, the remanence $B_r$ could not be recovered sufficiently. However, if the thickness of the surface portion to remove exceeded 500 μm, then the remanence $B_r$ could certainly be recovered but the coercivity $H_{cJ}$ could not be increased sufficiently. As a result, the coercivity $H_{cJ}$ would be lower than that of the magnet body that has just gone through the diffusion process.

The thickness of the surface portion to remove preferably falls within the range of 20 μm to 300 μm, more preferably within the range of 50 μm to 200 μm. The surface portion does not have to be removed by any particular technique but may be removed by a normal technique such as grinding or polishing.

In practice, the sintered magnet body that has gone through the surface portion removing process is preferably subjected to some surface treatment, which may be a known one such as Al evaporation, electrical Ni plating or resin coating. Before the surface treatment, the sintered magnet body may also be subjected to a known pre-treatment such as sandblast abrasion process, barrel abrasion process, or etching process.

On the surface of the sintered magnet body in which the heavy rare-earth element RH has already been diffused by evaporation diffusion process but from which the surface portion has not been removed yet, there is the light rare-earth element RL, which has been present in the grain boundary of the sintered magnet body and which now has an increased concentration due to the inter-diffusion between itself and RH. The light rare-earth element RL reacts to oxygen in the atmosphere to produce an oxide or a hydroxide on the surface of the sintered magnet body. According to the present invention, after the diffusion process gets done by evaporation diffusion, the surface portion of the sintered magnet body is removed to a depth of 5 μm or more. That is why once the surface portion has been removed, there will no longer be such RL oxide or RL hydroxide on the surface of the sintered magnet body.

As used herein, the "sintered magnet body" and the "magnet body" of the present invention are supposed to have not been subjected to the surface portion removing process yet, while the "sintered magnet" and the "magnet" are supposed to include the "sintered magnet body" and the "magnet" and have been subjected to the surface treatment as needed, for the sake of convenience.

EXAMPLES

Example 1

First, as shown in the following Table 5, three alloys were prepared by strip casting process so as to have target compositions including Dy in 0 mass %, 2.5 mass % and 5.0 mass %, respectively, thereby making thin alloy flakes with thicknesses of 0.2 mm to 0.3 mm. In Table 5, every numerical data is expressed in mass %.

TABLE 5

| Alloy | Nd | Dy | B | Co | Cu | Al | Fe |
|---|---|---|---|---|---|---|---|
| Dy 0% | 32.0 | 0 | 1.0 | 0.9 | 0.1 | 0.2 | bal |
| Dy 2.5% | 29.5 | 2.5 | 1.0 | 0.9 | 0.1 | 0.2 | bal |
| Dy 5.0% | 27.0 | 5.0 | 1.0 | 0.9 | 0.1 | 0.2 | bal |

Next, a vessel was loaded with those thin alloy flakes and then introduced into a hydrogen pulverizer, which was filled with a hydrogen gas atmosphere at a pressure of 500 kPa. In this manner, hydrogen was absorbed into the thin alloy flakes at room temperature and then desorbed. By performing such a hydrogen process, the thin alloy flakes were decrepitated to obtain a powder in indefinite shapes with sizes of about 0.15 mm to about 0.2 mm.

Thereafter, 0.05 wt % of zinc stearate was added to the coarsely pulverized powder obtained by the hydrogen process and then the mixture was pulverized with a jet mill to obtain a fine powder with a size of approximately 3 μm.

The fine powder thus obtained was compacted with a press machine to make a powder compact. More specifically, the powder particles were pressed and compacted while being aligned with a magnetic field applied. Thereafter, the powder compact was unloaded from the press machine and then subjected to a sintering process at 1,020° C. for four hours in a vacuum furnace, thus obtaining sintered blocks, which were then machined to obtain three sintered magnet bodies (Prototypes #1 to #3) having a thickness of 3 mm (in the magnetizing direction), a length of 7 mm and a width of 7 mm and including Dy in 0 mass %, 2.5 mass % and 5.0 mass %, respectively.

Figure 7:
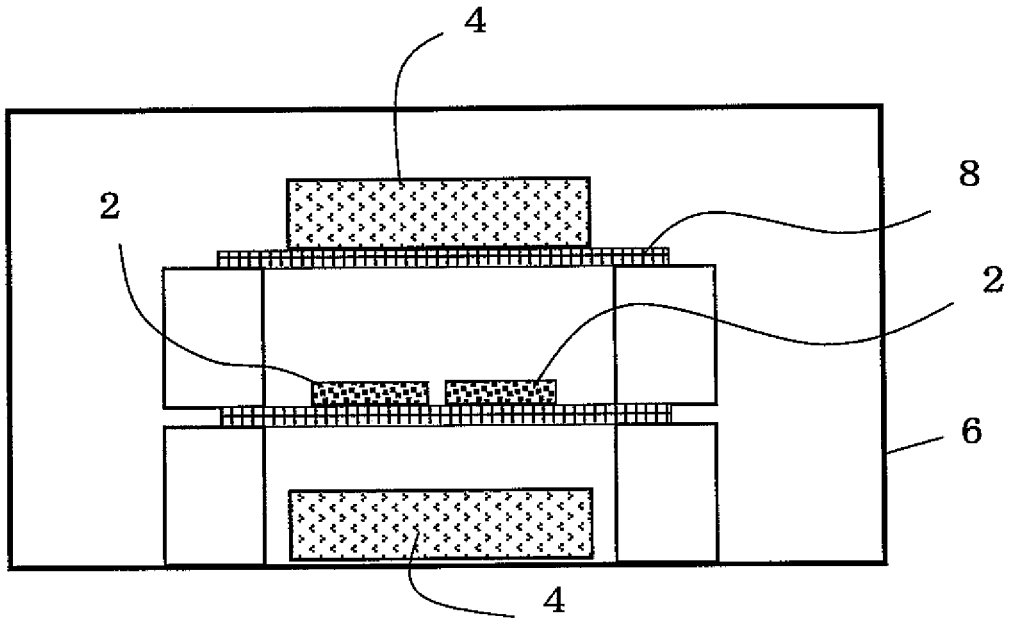
FIG. 7 illustrates an exemplary arrangement in a process vessel that was used in a specific example of the present invention.

These sintered magnet bodies were acid-cleaned with a 0.3% nitric acid aqueous solution, dried, and then arranged in a process vessel with the configuration shown in FIG. 7. The process vessel for use in this preferred embodiment was made of Mo and included a member for holding a plurality of sintered magnet bodies and a member for holding two RH bulk bodies. A gap of about 5 mm to about 9 mm was left between the sintered magnet bodies and the RH bulk bodies. The RH bulk bodies were made of Dy with a purity of 99.9% and had dimensions of 30 mm×30 mm×5 mm.

Next, the process vessel shown in FIG. 7 was heated in a vacuum heat treatment furnace at an atmospheric gas pressure of $1\times10^{-2}$ Pa and at a temperature of 900° C. for 120 minutes, thereby conducting a heat treatment. After that, an aging treatment was carried out at a pressure of 2 Pa and at a temperature of 500° C. for 120 minutes.

The diffusion process was carried out in the following three sets of conditions (which will be referred to herein as "diffusion process conditions A, B and C"):

TABLE 6

| | Diffusion process conditions | Thickness of surface portion removed |
|---|---|---|
| A | Evaporation diffusion at 900° C. in 120 minutes | 100 μm |
| B | Evaporation diffusion at 850° C. in 240 minutes | 50 μm |
| C | Deposition of Dy by sputtering and post-deposition heat treatment at 900° C. in 120 minutes | 100 μm |

In the following description, samples obtained by subjecting Prototypes #1 to #3 to the diffusion process under the diffusion process condition A will be referred to herein as "Samples A1, A2 and A3". In the same way, samples obtained by subjecting Prototypes #1 to #3 to the diffusion process under the diffusion process condition B will be referred to herein as "Samples B1, B2 and B3". Meanwhile, the diffusion process condition C was the condition of a diffusion process that was carried out on a comparative example. And a sample obtained by subjecting Prototype #1 to the diffusion process under the diffusion process condition C will be referred to herein as "Sample C1".

It should be noted that the "heat treatment temperature" will mean herein the temperature of the sintered magnet bodies and that of the RH bulk bodies, which is approximately equal to that of the sintered magnet bodies, unless otherwise stated.

A line analysis was carried out on a cross section of Samples A1, A2 and A3, covering a range from a depth of 0 μm through a depth of 250 μm and from its surface through around its core, using an EPMA (EPM1610 produced by Shimadzu Corporation). The results of the line analysis on Dy are shown in FIG. 3. As can be seen from FIG. 3, in Samples A1, A2 and A3 that had been subjected to the diffusion process, the ingrain diffusion had advanced to reach a depth of around 100 μm.

In the same way, a line analysis was also carried out on a cross section of Samples B1, B2 and B3, covering a range from a depth of 0 μm through a depth of 250 μm and from its surface through around its core, using the same EPMA. The results of the line analysis on Dy are shown in FIG. 4. As can be seen from FIG. 4, in Samples B1, B2 and B3 that had been subjected to the diffusion process, the ingrain diffusion had advanced to reach a depth of around 30 μm.

And for the purpose of comparison, a Dy film was deposited to a thickness of approximately 15 μm on the surface of Prototype #1 by sputtering process, and then subjected to a heat treatment process at the same heat treatment temperature and in the same amount of time as the evaporation diffusion process on Sample A1, thereby obtaining Sample C1. It was discovered that in Sample C1, the ingrain diffusion had advanced to reach a depth of around 500 μm.

After having gone through the heat treatment process for diffusion, these samples were subjected to the process of removing their surface portion by grinding it with a surface grinder. Specifically, Prototypes, Samples A1 to A3 and Sample C1 had their magnet body surface portions (having dimensions of 7 mm square on both sides) removed to a depth of approximately 100 μm each side. On the other hand, Samples B1 to B3 had their magnet body surface portions (having dimensions of 7 mm square on both sides) removed to a depth of approximately 50 μm each side. And before and after those surface portions were removed, their magnetic properties (including the remanence $B_r$ and the coercivity $H_{cJ}$) were measured with a B—H tracer. The results of the measurements are shown in the following Table 7.

After their surface portions had been removed, Prototypes and Samples A1 to A3, B1 to B3 and C1 had their surface portions removed once again to a depth of 200 μm each side and then had their coercivity measured by the same method as what has already been described. The differences $\Delta H_{cJ}1$ between their coercivity values before and after their surface portions had been removed again to 200 μm are also shown in the following Table 7. As can be seen from the following Table 7, Samples A1 to A3 and B1 to B3 had a magnet $\Delta H_{cJ}1$ of 200 kA/m or less and there was a relatively narrow difference in coercivity between their magnet body surface portions and their portions deeper by 200 μm. As for Sample C1, on the other hand, the magnet $\Delta H_{cJ}1$ was 150 kA/m and there was a relatively big difference in coercivity between its magnet body surface portions and its portions deeper by 200 μm.

TABLE 7

| | | Before surface portion was removed | | After surface portion was removed | | After surface portion was further removed by 200 μm | |
|---|---|---|---|---|---|---|---|
| | Dy concentration | $B_r$ [T] | $H_{cJ}$ [kA/m] | $B_r$ [T] | $H_{cJ}$ [kA/m] | $H_{cJ}$ [kA/m] | $\Delta H_{cJ}1$ [kA/m] |
| Prototype 1 | 0 mass % | 1.40 | 850 | 1.40 | 850 | 850 | 0 |
| A1 | | 1.38 | 1280 | 1.40 | 1270 | 1240 | 30 |
| B1 | | 1.39 | 1280 | 1.40 | 1270 | 1200 | 70 |
| C1 | | 1.36 | 1250 | 1.37 | 1220 | 1070 | 150 |
| Prototype 2 | 2.5 mass % | 1.33 | 1380 | 1.33 | 1380 | 1380 | 0 |
| A2 | | 1.31 | 1860 | 1.33 | 1850 | 1810 | 40 |
| B2 | | 1.31 | 1800 | 1.33 | 1800 | 1710 | 90 |
| Prototype 3 | 5.0 mass % | 1.27 | 1780 | 1.27 | 1780 | 1780 | 0 |
| A3 | | 1.25 | 2230 | 1.27 | 2225 | 2180 | 45 |
| B3 | | 1.26 | 2250 | 1.27 | 2240 | 2170 | 30 |

As described above, as for the magnet bodies that had been subjected to the evaporation diffusion process and then had their surface portion removed (representing Samples A1 to A3 and Samples B1 to B3), by removing the surface portion that would otherwise decrease the remanence $B_r$ slightly, a sintered magnet, of which the coercivity had been increased significantly without decreasing the remanence, could be obtained. On the other hand, as for Sample C1 in which a Dy film was deposited by sputtering and then Dy was diffused through heat treatment, even if the surface portion was removed, $B_r$ could not be recovered.

The cross-sectional structure of Samples A1 to A3 and B1 to B3, from which the surface portion had already been removed, was analyzed with an EPMA around a depth of 20 μm under the surface of the magnet body, from which the surface portion had already been removed. As a result, the present inventors confirmed that a compound with a uniform composition $(Nd_{1-x}Dy_x)_2Fe_{14}B$ (i.e., a Dy diffused layer) had been produced in the outer periphery of the main phase. The respective thicknesses and compositions (i.e., the Dy concentration x) of these Dy diffused layers are shown in the following Table 8. It should be noted that the thickness of each of these diffused layers was calculated as the average of the thicknesses measured at ten arbitrary points in main phase crystal grains. As for Sample A1, the Dy diffused layer in a single main phase crystal grain, located at a depth of around 20 μm under the surface of the magnet body, was analyzed at ten arbitrary points with a TEM. The results are shown in the following Table 9. According to Table 9, x had a maximum value of 0.386 and a minimum value of 0.374, and the dispersion of the x values was 10% or less. When the present inventors carried out a similar analysis on the other samples A2, A3 and B1 to B3, we confirmed that the x values had a dispersion of 10% or less. Also, when looking into a cross-sectional structure of Sample C1 at a depth of approximately 20 μm under the surface of the magnet body, we discovered that Dy diffused reached the vicinity of the core of the main phase.

Furthermore, when the present inventors analyzed, using a TEM, a cross-sectional structure of Samples A1 to A3 and B1 to B3 around a depth of 500 μm under the surface of the magnet body, from which the surface portion had already been removed, we confirmed the presence of a compound with the composition $(Nd_{1-x}Dy_x)_2Fe_{14}B$ (where $0.2 \leq x \leq 0.75$), i.e., a Dy diffused layer, having an average thickness of 0.5 μm or less (as the average of thicknesses measured at 10 points) in the outer periphery of the main phase.

TABLE 8

| Sample | Thickness (μm) of Dy diffused layer | D1: Dy concentration (mass %) at core of crystal grains | D2: Dy concentration (mass %) in diffused layer | Amount (mass %) of Dy introduced (D1 − D2) | $(Nd_{1-x}Dy_x)_2Fe_{14}B$ |
|---|---|---|---|---|---|
| A1 | 1 | 0 | 11.6 | 11.6 | 0.38 |
| B1 | 0.8 | 0 | 10.0 | 10.0 | 0.26 |
| C1 | >2 μm (reached near core of main phase) | 0 | 11.5 | 11.5 | 0.37 |
| A2 | 1 | 2.4 | 12.0 | 9.6 | 0.47 |
| B2 | 0.8 | 2.4 | 10.8 | 8.4 | 0.40 |
| A3 | 0.9 | 5.2 | 14.0 | 8.8 | 0.52 |
| B3 | 0.7 | 5.2 | 13.2 | 8.0 | 0.49 |

TABLE 9

| Sample | Thickness (μm) of Dy diffused layer | D1: Dy concentration (mass %) at core of crystal grains | D2: Dy concentration (mass %) in diffused layer | Amount (mass %) of Dy introduced (D1 − D2) | $(Nd_{1-x}Dy_x)_2Fe_{14}B$ |
|---|---|---|---|---|---|
| A1 | 1 | 0 | 11.6 | 11.6 | 0.380 |
| | | | 11.6 | 11.6 | 0.386 |
| | | | 11.3 | 11.3 | 0.374 |
| | | | 11.3 | 11.3 | 0.374 |
| | | | 11.6 | 11.6 | 0.380 |
| | | | 11.6 | 11.6 | 0.386 |
| | | | 11.6 | 11.6 | 0.382 |
| | | | 11.3 | 11.3 | 0.378 |
| | | | 11.6 | 11.6 | 0.380 |
| | | | 11.6 | 11.6 | 0.382 |

Example 2

First, using an alloy that had the composition shown in the following Table 10, thin alloy flakes D were made by strip casting process so as to have thicknesses of 0.2 mm to 0.3 mm.

TABLE 10

| Alloy | Nd | Dy | B | Co | Cu | Al | Fe |
|---|---|---|---|---|---|---|---|
| Thin flakes D | 25.0 | 4.0 | 1.0 | 2.0 | 0.1 | 0.1 | bal |

Using those thin alloy flakes, sintered blocks were made by the same method as the one adopted in the first specific example described above. Then, by machining those sintered blocks, sintered magnet bodies having a length of 20 mm and a width of 20 mm and having their thickness varied from 3 mm through 7 mm in the magnetization direction were obtained as Prototypes #4, #5 and #6.

These sintered magnet bodies were acid-cleaned with a 0.3% nitric acid aqueous solution, dried, and then arranged in a process vessel with the configuration shown in FIG. 7. The process vessel for use in this preferred embodiment was made of Mo and included a member for holding a plurality of sintered magnet bodies and a member for holding two RH bulk bodies. A gap of about 5 mm to about 10 mm was left between the sintered magnet bodies and the RH bulk bodies. The RH bulk bodies were made of Dy with a purity of 99.9% and had dimensions of 30 mm×30 mm×5 mm.

Next, the process vessel shown in FIG. 7 was heated in a vacuum heat treatment furnace at an atmospheric gas pressure of $1\times10^{-2}$ Pa and at a temperature of 900° C. for 1 to 5 hours, thereby conducting a heat treatment. After that, an aging treatment was carried out at a pressure of 2 Pa and at a temperature of 500° C. for two hours. Thereafter, the surface portion of those sintered magnet bodies was ground and removed by 50 μm using a surface grinder, thereby obtaining Reference Examples #4 through #6. And the magnetic properties (i.e., the bulk properties) of those Reference Examples were measured. Furthermore, those reference examples were sliced at regular steps of 1 mm in the magnetization direction to obtain sintered magnet bodies having a length of 7 mm, a width of 7 mm and a thickness of 1 mm in the magnetization direction. And then their magnetic properties (which will be referred to herein as "sliced properties") were measured.

Meanwhile, without putting the RH bulk bodies into the vacuum heat treatment furnace, those Reference Examples #4 to #6 were subjected to an additional heat treatment there at an atmospheric gas pressure of $1\times10^{-2}$ Pa and at a temperature of 900° C. for six hours and then subjected to an aging treatment at a pressure of 2 Pa and at an temperature of 500° C. for two more hours. Thereafter, the surface portion of those sintered magnet bodies was ground and removed by 50 μm using a surface grinder, thereby obtaining Specific Examples #4 through #6 of the present invention. And then their bulk properties and sliced properties were evaluated by the same methods as the ones adopted for Reference Examples #4 to #6.

The results are shown in the following Table 11. As for the sliced properties, the highest and lowest coercivities $H_{cJ}$-max and $H_{cJ}$-min of each sliced sample are shown and their difference in coercivity is represented by $\Delta H_{cJ}3$.

TABLE 11

| Sample | Magnet thickness | Bulk properties $B_r$ (T) | Bulk properties $H_{cJ}$ (kA/m) | Sliced properties $H_{cJ}$ max (kA/m) | Sliced properties $H_{cJ}$ min (kA/m) | $\Delta H_{cJ}3$ (kA/m) |
|---|---|---|---|---|---|---|
| Prototype 4 | 3 mm | 1.38 | 1600 | NA | NA | NA |
| Prototype 5 | 5 mm | 1.38 | 1600 | NA | NA | NA |
| Prototype 6 | 7 mm | 1.38 | 1600 | NA | NA | NA |
| Reference 4 | 3 mm | 1.38 | 2100 | 2140 | 1990 | 150 |
| Reference 5 | 5 mm | 1.38 | 1980 | 2080 | 1810 | 270 |
| Reference 6 | 7 mm | 1.38 | 1880 | 2050 | 1660 | 390 |
| Example 4 | 3 mm | 1.38 | 2120 | 2150 | 2060 | 90 |
| Example 5 | 5 mm | 1.38 | 2040 | 2090 | 1950 | 140 |
| Example 6 | 7 mm | 1.38 | 2010 | 2070 | 1880 | 190 |

As can be seen from this Table 11, by conducting the additional heat treatment, the relatively low coercivity could be increased and the coercivity difference $\Delta H_{cJ}3$ decreased in each sintered magnet body. In any of these samples, such a portion with the low coercivity was the core portion (with a thickness of 1 mm) of the sintered magnet body, while a portion with the highest coercivity was the surface portion with a thickness of 1 mm. The present inventors also discovered that their coercivity could be increased particularly effectively if the magnet had a thickness of 3 mm or more.

Furthermore, as for Reference Examples #4 to #6 and Specific Examples #4 to #6, their surface region (with a thickness of 1 mm) was divided into two halves, each having a thickness of 500 μm, and their properties ($H_{cJ}$-max) were measured. The results are shown in the following Table 12.

TABLE 12

| Sample | Magnet thickness | Surface portion (1 mm) $H_{cJ}$-max (kA/m) | After the surface region (1 mm) was divided into two halves: Shallower 500 μm (kA/m) | Deeper 500 μm (kA/m) | $\Delta H_{cJ}2$ (kA/m) |
|---|---|---|---|---|---|
| Reference 4 | 3 mm | 2140 | 2160 | 2100 | 60 |
| Reference 5 | 5 mm | 2080 | 2120 | 2010 | 110 |
| Reference 6 | 7 mm | 2050 | 2110 | 1960 | 150 |
| Example 4 | 3 mm | 2150 | 2160 | 2130 | 30 |
| Example 5 | 5 mm | 2090 | 2120 | 2060 | 60 |
| Example 6 | 7 mm | 2070 | 2120 | 2030 | 90 |

As can be seen from Table 12, when the surface portion (with a thickness of 1 mm) was divided into two halves, the difference $\Delta H_{cJ}2$ in property between the shallower and deeper portions of the magnet was as small as 150 kA/m or less. Thus, it can be seen that according to the evaporation diffusion process, Dy diffused reached deep inside the magnet. Although samples that had been made under different conditions (including thickness and diffusion condition) were also evaluated in the same way, their $\Delta H_{cJ}2$ never exceeded 300 kA/m.

Example 3

Using Prototype #5 of EXAMPLE 2, the process vessel shown in FIG. 7 was heated in a vacuum heat treatment furnace at an atmospheric gas pressure of $1\times10^{-2}$ Pa and at a temperature of 800° C. or 850° C. for 5 to 10 hours, thereby conducting a heat treatment. After that, an aging treatment was carried out at a pressure of 2 Pa and at a temperature of 500° C. for two hours. Thereafter, the surface portion of the sintered magnet body was ground and removed by 20 μm using a surface grinder, thereby obtaining Specific Examples #7 and #8.

And the magnetic properties (i.e., the bulk properties) of those Specific Examples were measured. Furthermore, those specific examples were sliced at regular steps of 1 mm in the magnetization direction to obtain sintered magnet bodies having a length of 7 mm, a width of 7 mm and a thickness of 1 mm in the magnetization direction. And then their magnetic properties (which will be referred to herein as "sliced properties") were measured.

The results are shown in the following Table 13, in which the heat treatment at 800° C. was carried out for 10 hours and the heat treatment at 850° C. was carried out for 5 hours.

TABLE 13

| Sample | Heat treatment temperature | Bulk properties Br (T) | Bulk properties HcJ (kA/m) | Sliced properties HcJ-max (kA/m) | Sliced properties HcJ-min (kA/m) | Sliced properties ΔHcJ3 (kA/m) |
|---|---|---|---|---|---|---|
| Prototype 5 | NA | 1.38 | 1600 | NA | NA | NA |
| Example 7 | 800° C. | 1.38 | 2000 | 2030 | 1930 | 100 |
| Example 8 | 850° C. | 1.38 | 2020 | 2060 | 1910 | 150 |

As can be seen from this Table 13, by lowering the heat treatment temperature and extending the heat treatment process time, the coercivity difference $\Delta H_{cJ}3$ could be decreased in each sintered magnet body.

Example 4

First, using an alloy that had the composition shown in the following Table 14, thin alloy flakes E were made by strip casting process so as to have thicknesses of 0.2 mm to 0.3 mm.

TABLE 14

| Alloy | Nd | Pr | Dy | B | Co | Cu | Al | Fe |
|---|---|---|---|---|---|---|---|---|
| Thin flakes E | 25.0 | 6.0 | 1.0 | 1.0 | 0.9 | 0.1 | 0.1 | bal |

Using those thin alloy flakes, a sintered block was made by the same method as the one adopted in the first specific example described above. Then, by machining that sintered block, a sintered magnet body having a length of 20 mm and a width of 20 mm and a thickness of 5 mm in the magnetization direction was obtained as Prototype #7.

That sintered magnet body was acid-cleaned with a 0.3% nitric acid aqueous solution, dried, and then arranged in a process vessel with the configuration shown in FIG. 7. The process vessel for use in this preferred embodiment was made of Mo and included a member for holding a plurality of sintered magnet bodies and a member for holding two RH bulk bodies. A gap of about 5 mm to about 10 mm was left between the sintered magnet bodies and the RH bulk bodies. The RH bulk bodies were made of Dy with a purity of 99.9% and had dimensions of 30 mm×30 mm×5 mm.

Next, the process vessel shown in FIG. 7 was heated in a vacuum heat treatment furnace at an atmospheric gas pressure of $1\times10^{-2}$ Pa and at a temperature of 900° C. for 4 hours, thereby conducting a heat treatment. After that, an aging treatment was carried out at a pressure of 2 Pa and at a temperature of 500° C. for two hours to obtain Reference Example #7. The magnetic properties (i.e., the bulk properties) of that reference example were measured and then the reference example was sliced at regular steps of 1 mm in the magnetization direction to obtain a sintered magnet body having a length of 7 mm, a width of 7 mm and a thickness of 1 mm in the magnetization direction. And then its magnetic properties (which will be referred to herein as "sliced properties") were measured.

Meanwhile, without putting the RH bulk bodies into the vacuum heat treatment furnace, Reference Example #7 was subjected to an additional heat treatment there at an atmospheric gas pressure of $1\times10^{-2}$ Pa and at a temperature of 900° C. for 1 to 10 hours and then subjected to an aging treatment at a pressure of 2 Pa and at an temperature of 500° C. for two more hours. Thereafter, the surface portion of the sintered magnet body was ground and removed by 50 μm using a surface grinder, thereby obtaining Specific Examples #7 through #9 of the present invention. And then their bulk properties and sliced properties were evaluated by the same methods as the ones adopted for Reference Example #7.

The results are shown in the following Table 15.

TABLE 15

| Sample | Additional heat treatment process time | Bulk properties $B_r$ (T) | Bulk properties $H_{cJ}$ (kA/m) | Sliced properties $H_{cJ}$-max (kA/m) | Sliced properties $H_{cJ}$-min (kA/m) | Sliced properties $\Delta H_{cJ}3$ (kA/m) |
|---|---|---|---|---|---|---|
| Prototype 7 | NA | 1.37 | 1150 | NA | NA | NA |
| Reference 5 | NA | 1.36 | 1450 | 1570 | 1260 | 310 |
| Example 7 | 1 hr | 1.37 | 1470 | 1570 | 1300 | 270 |
| Example 8 | 5 hrs | 1.37 | 1520 | 1580 | 1410 | 170 |
| Example 9 | 10 hrs | 1.37 | 1550 | 1580 | 1490 | 90 |

As can be seen from the results of measurements shown in this Table 15, by extending the additional heat treatment process time, the coercivity difference $\Delta H_{cJ}3$ could also be reduced even in a sintered magnet body that was as thick as 5 mm.

INDUSTRIAL APPLICABILITY

According to the present invention, main phase crystal grains, including a heavy rare-earth element RH at an efficiently increased concentration in their outer periphery, can be obtained, thus providing a high-performance magnet that has both high remanence and high coercivity alike.

The invention claimed is:

1. An R—Fe—B based rare-earth sintered magnet comprising an R—Fe—B based rare-earth sintered magnet body that includes, as a main phase, crystal grains of an $R_2Fe_{14}B$ type compound, including a light rare-earth element RL, which is at least one of Nd and Pr, as a major rare-earth element R, and a heavy rare-earth element RH, which is at least one element selected from the group consisting of Dy, Ho and Tb, wherein at a depth of 20 μm under the surface of the R—Fe—B based rare-earth sintered magnet body, the crystal grains of the $R_2Fe_{14}B$ type compound include an RH diffused layer at an outer periphery of the crystal grains, the RH diffused layer having an average thickness of 2 μm or less and having a composition of $(RL_{1-x}RH_x)_2Fe_{14}B$, where $0.2\leq x\leq0.75$, wherein at a depth of 500 μm under the surface of the R—Fe—B based rare-earth sintered magnet body, the crystal grains of the $R_2Fe_{14}B$ type compound have an RH diffused layer with an average thickness of 0.5 μm or less in their outer periphery, wherein the surface of the R—Fe—B based rare-earth sintered magnet body is a machined surface that is not covered with a metal layer of the heavy rare-earth element RH and that is a surface of the R—Fe—B based rare-earth sintered magnet body, from which its surface portion has already been removed after the heavy rare-earth element RH has been introduced into the R—Fe—B based rare-earth sintered magnet body from outside of the R—Fe—B based rare-earth sintered magnet body, wherein the R—Fe—B based rare-earth sintered magnet body has a size of 1 mm to 4 mm as measured in a thickness direction, wherein a difference $\Delta H_{cJ}1$ in coercivity is 150 kA/m or less between:

the entire R—Fe—B based rare-earth sintered magnet body; and a portion of the R—Fe—B based rare-earth sintered magnet body below a distance of 200 μm from the surface of the R—Fe—B based rare-earth sintered magnet body, and wherein the magnet has an RH-RL-O compound in at least one grain boundary triple junction, which is located at a depth of 100 μm or less under the surface of the R—Fe—B based rare-earth sintered magnet body.

2. The R—Fe—B based rare-earth sintered magnet of claim 1, wherein at a depth of 500 μm under the surface of the R—Fe—B based rare-earth sintered magnet body, the crystal grains of the $R_2Fe_{14}B$ type compound include an RH diffused layer having a composition $(RL_{1-x}RH_x)_2Fe_{14}B$, where $0.2 \leq x \leq 0.75$.

3. The R—Fe—B based rare-earth sintered magnet of claim 1, wherein in a region of the R—Fe—B based rare-earth sintered magnet body between the depths of 20 μm and 500 μm under a surface of the R—Fe—B based rare-earth sintered magnet body, the crystal grains of the $R_2Fe_{14}B$ type compound have an RH diffused layer in their outer periphery, and wherein the greater the depth under the surface of the R—Fe—B based rare-earth sintered magnet body, the thinner the RH diffused layer gets in the outer periphery of the crystal grains of the $R_2Fe_{14}B$ type compound.

4. The R—Fe—B based rare-earth sintered magnet of claim 1, wherein the RH diffused layer has a uniform composition in which x has a dispersion of 10% or less at least within a single crystal grain.

5. The R—Fe—B based rare-earth sintered magnet of claim 1, wherein the thickness of the RH diffused layer is 20% or less of the average grain size of the crystal grains of the $R_2Fe_{14}B$ type compound.

6. The R—Fe—B based rare-earth sintered magnet of claim 1, wherein in the crystal grains of the $R_2Fe_{14}B$ type compound at the depth of 20 μm under the surface of the R—Fe—B based rare-earth sintered magnet body, the concentration of RH in the $(RL_{1-x}RH_x)_2Fe_{14}B$, where $0.2 \leq x \leq 0.75$, layer is at least 6.0 mass % greater than that of RH at a core of the crystal grains.

7. The R—Fe—B based rare-earth sintered magnet of claim 1, wherein in at least one of the crystal grains of the $R_2Fe_{14}B$ type compound that are located at the depth of 100 μm or less under the surface of the R—Fe—B based rare-earth sintered magnet body, the concentration of RH in the RH diffused layer is smaller than the concentration of RH of the RH-RL-O compound in the at least one grain boundary triple junction, which surrounds the crystal grain of the $R_2Fe_{14}B$ type compound, but greater than that of the rest of the at least one grain boundary triple junction other than the RH-RL-O compound.

8. An R—Fe—B based rare-earth sintered magnet comprising an R—Fe—B based rare-earth sintered magnet body that includes, as a main phase, crystal grains of an $R_2Fe_{14}B$ type compound, including a light rare-earth element RL, which is at least one of Nd and Pr, as a major rare-earth element R, and a heavy rare-earth element RH, which is at least one element selected from the group consisting of Dy, Ho and Tb, wherein at a depth of 20 μm under the surface of the R—Fe—B based rare-earth sintered magnet body, the crystal grains of the $R_2Fe_{14}B$ type compound include an RH diffused layer at an outer periphery of the crystal grains, the RH diffused layer having an average thickness of 2 μm or less and having a composition of $(RL_{1-x}RH_x)_2Fe_{14}B$, where $0.2 \leq x \leq 0.75$, wherein at a depth of 500 μm under the surface of the R—Fe—B based rare-earth sintered magnet body, the crystal grains of the $R_2Fe_{14}B$ type compound have an RH diffused layer with an average thickness of 0.5 μm or less in their outer periphery, wherein the surface of the R—Fe—B based rare-earth sintered magnet body is a machined surface that is not covered with a metal layer of the heavy rare-earth element RH and that is a surface of the R—Fe—B based rare-earth sintered magnet body, from which its surface portion has already been removed after the heavy rare-earth element RH has been introduced into the R—Fe—B based rare-earth sintered magnet body from outside of the R—Fe—B based rare-earth sintered magnet body, wherein the R—Fe—B based rare-earth sintered magnet body has a size of more than 4 mm in the thickness direction, wherein a surface region of the R—Fe—B based rare-earth sintered magnet body has a thickness of 1 mm as measured from a surface of the R—Fe—B based rare-earth sintered magnet body and includes:

a first layer portion with a thickness of 500 μm as measured from the surface; and a second layer portion that is located deeper inside the R—Fe—B based rare-earth sintered magnet body than the first layer portion and that has a thickness of 500 μm, wherein a difference $\Delta H_{cJ}2$ in coercivity between the first and second layer portions is 300 kA/m or less, and wherein the magnet has an RH-RL-O compound in at least one grain boundary triple junction, which is located at a death of 100 μm or less under the surface of R—Fe—B based rare-earth sintered magnet body.

9. The R—Fe—B based rare-earth sintered magnet of claim 8, wherein at a depth of 500 μm under the surface of the R—Fe—B based rare-earth sintered magnet body, the crystal grains of the $R_2Fe_{14}B$ type compound include an RH diffused layer having a composition $(RL_{1-x}RH_x)_2Fe_{14}B$, where $0.2 \leq x \leq 0.75$.

10. The R—Fe—B based rare-earth sintered magnet of claim 8, wherein in a region of the R—Fe—B based rare-earth sintered magnet body between the depths of 20 μm and 500 μm under a surface of the R—Fe—B based rare-earth sintered magnet body, the crystal grains of the $R_2Fe_{14}B$ type compound have an RH diffused layer in their outer periphery, and wherein the greater the depth under the surface of the R—Fe—B based rare-earth sintered magnet body, the thinner the RH diffused layer gets in the outer periphery of the crystal grains of the $R_2Fe_{14}B$ type compound.

11. The R—Fe—B based rare-earth sintered magnet of claim 8, wherein the RH diffused layer has a uniform composition in which x has a dispersion of 10% or less at least within a single crystal grain.

12. The R—Fe—B based rare-earth sintered magnet of claim 8, wherein the thickness of the RH diffused layer is 20% or less of the average grain size of the crystal grains of the $R_2Fe_{14}B$ type compound.

13. The R—Fe—B based rare-earth sintered magnet of claim 8, wherein in the crystal grains of the $R_2Fe_{14}B$ type compound at the depth of 20 μm under the surface of the R—Fe—B based rare-earth sintered magnet body, the concentration of RH in the $(RL_{1-x}RH_x)_2Fe_{14}B$, where $0.2 \leq x \leq 0.75$, layer is at least 6.0 mass % greater than that of RH at a core of the crystal grains.

14. The R—Fe—B based rare-earth sintered magnet of claim 8, wherein in at least one of the crystal grains of the $R_2Fe_{14}B$ type compound that are located at the depth of 100 μm or less under the surface of the R—Fe—B based rare-earth sintered magnet body, the concentration of RH in the RH diffused layer is smaller than the concentration of RH of the RH-RL-O compound in the at least one grain boundary triple junction, which surrounds the crystal grain of the $R_2Fe_{14}B$ type compound, but greater than that of the rest of the at least one grain boundary triple junction other than the RH-RL-O compound.

* * * * *